US011440073B2

(12) United States Patent
Nardone

(10) Patent No.: US 11,440,073 B2
(45) Date of Patent: Sep. 13, 2022

(54) INCREMENTAL SHEET FORMING SYSTEM WITH RESILIENT TOOLING

(71) Applicant: FIGUR MACHINE TOOLS LLC, Boonton, NJ (US)

(72) Inventor: Justin Michael Nardone, Mountain Lakes, NJ (US)

(73) Assignee: Figur Machine Tools LLC, Boonton, NJ (US)

( * ) Notice: Subject to any disclaimer, the term of this patent is extended or adjusted under 35 U.S.C. 154(b) by 40 days.

(21) Appl. No.: 16/866,172

(22) Filed: May 4, 2020

(65) Prior Publication Data

US 2020/0353526 A1 Nov. 12, 2020

Related U.S. Application Data

(60) Provisional application No. 63/006,802, filed on Apr. 8, 2020, provisional application No. 62/844,177, filed on May 7, 2019.

(51) Int. Cl.

| | |
|---|---|
| ***B21D 22/02*** | (2006.01) |
| ***B21D 22/26*** | (2006.01) |
| ***B21D 22/22*** | (2006.01) |

(52) U.S. Cl.

CPC ..... *B21D 22/02* (2013.01); *B21D 22/22* (2013.01); *B21D 22/26* (2013.01)

(58) Field of Classification Search

CPC ..... B21D 35/005; B21D 22/02; B21D 22/22; B21D 22/26; B21D 43/12

See application file for complete search history.

(56) References Cited

U.S. PATENT DOCUMENTS 3,072,308 A 1/1963 Oakes et al.
3,216,635 A * 11/1965 Lefevre ..... C03B 33/03 225/96.5

(Continued)

FOREIGN PATENT DOCUMENTS

JP H10314855 A 12/1998

OTHER PUBLICATIONS

Emmens et al., "The Technology of Incremental Sheet Forming—A brief review of the history", Journal of Materials Processing Technology, vol. 210, Issue 8, Jun. 1, 2010, pp. 981-997.

(Continued)

*Primary Examiner* — Jessica Cahill
*Assistant Examiner* — Bobby Yeonjin Kim
(74) *Attorney, Agent, or Firm* — George W. Johnston

(57) ABSTRACT

The present invention is directed to a dual sided incremental sheet forming apparatus and method for incrementally forming sheet materials such as sheet metal by utilizing opposed primary and secondary forming tool assemblies and a sheet feeding assembly. The primary forming tool assembly includes a rigid tool and the secondary forming tool assembly includes a compressible and resilient backing layer having either a cylindrical or flat configuration. The sheet feeding assembly positions the sheet material between the two forming tools. The rigid tool applies force to one surface of the sheet material while the resilient backing tool applies counter force to the opposite surface of the work piece as it supports the work piece. This dual sided process localizes the forces on the sheet material so that stresses are advantageously controlled to produce accurately formed asymmetric shapes, without the need for expensive dies. The use of a rigid tool with an opposed resilient backing tool both having linear independent motion also avoids potential wrinkling and tearing of the resulting work piece and (Continued)

enables the formation of numerous, highly detained asymmetric products.

27 Claims, 10 Drawing Sheets

(56) References Cited

U.S. PATENT DOCUMENTS

| | | | | |
|---|---|---|---|---|
| 3,342,051 | A | 9/1967 | Leszak | |
| 4,057,184 | A | 11/1977 | Michalik | |
| 4,558,622 | A | 12/1985 | Tauscheck | |
| 5,301,867 | A | 4/1994 | Bando | |
| 6,151,938 | A | 11/2000 | Park et al. | |
| 7,536,892 | B2 | 5/2009 | Amino et al. | |
| 7,960,016 | B2 * | 6/2011 | Lechthaler | C23C 28/042 428/217 |
| 8,302,442 | B2 | 11/2012 | Kiridena et al. | |
| 8,322,176 | B2 * | 12/2012 | Johnson | B21D 17/04 72/75 |
| 8,773,143 | B2 | 5/2014 | Kiridena et al. | |
| 8,783,078 | B2 | 7/2014 | Ren et al. | |
| 2004/0211218 | A1 | 10/2004 | Jotaki | |

OTHER PUBLICATIONS

Jeswiet et al., "Asymmetric Single Point Incremental Forming of Sheet Metal". CIRP Annals—Manufacturing Technology 54(2): 88-114 (Dec. 2005).

Jeswiet et al., "Metal Forming Progress since 2000" CIRP Journal of Manufacturing Science and Technology, vol. 1, Issue 1, 2008, pp. 2-17.

The Invitation to Pay Additional Fees, mailed on Jun. 30, 2020, in the corresponding PCT Appl. No. PCT/US20/31336.

The International Search Report and Written Opinion, dated Sep. 15, 2020, in the corresponding PCT Appl. No. PCT/US20/31336.

* cited by examiner

INCREMENTAL SHEET FORMING SYSTEM WITH RESILIENT TOOLING

CROSS-REFERENCE TO RELATED APPLICATIONS

This application claims priority to Provisional Application No. 62/844,177, filed May 7, 2019, and claims priority to Provisional Application No. 63/006,802, filed Apr. 8, 2020, each of which hereby are incorporated herein by reference in their entirety.

FIELD OF THE INVENTION

The present invention relates to an apparatus and method for incrementally forming sheet materials such as sheet metal.

BACKGROUND OF THE INVENTION

Numerous methods for forming sheet materials (typically metal) into complex shapes have been developed over the years. Sheet forming technologies exist across a wide range of industries and apply to a variety of metals and plastics. Typical high-volume production of sheet metal parts utilizes stamping technology. Stamping requires the use of two rigid dies that are machined with high levels of accuracy. A sheet of material (i.e., work piece) is pressed between the two dies to form the material into the desired configuration as established by the dies.

Alternative methods to stamping have been utilized to shape the sheet material without the need for a full set of two dies. Instead, a single rigid die is positioned on one side of a sheet of material. Then, force is applied to the other side of the material by using a backing material or by fluid pressure, thus forming the material into the desired configuration as determined by the single die. While the use of one or two dies in sheet metal forming technologies have advanced over the years, the expense of engineering, manufacturing and maintaining any die discourages low volume production of metal parts.

In addition to the manufacturing cost of the die(s), the time to produce the die(s) further discourages small volume and prototype use.

Another technique for forming sheet materials is called Incremental Sheet Forming (ISF) in which at any time only a small portion of the sheet metal is actually being incrementally configured by formation. Emmens et al., "The Technology of Incremental Sheet Forming—A brief review of the history", Journal of Materials Processing Technology (2010) and Jeswiet et al., Asymmetric Single Point Incremental Forming of Sheet Metal. CIRP Annals—Manufacturing Technology 54(2): 88-114 (December 2005).

The incremental sheet metal forming system of the present invention not only provides flexibility over prior systems by removing the long lead times and need for producing and using expensive dies to form complex sheet metal parts, but additionally localizes the forming forces on the work piece so as to control precisely and locally the stress that occurs during formation of the sheet material.

DESCRIPTION OF THE RELATED ART

Single Point Incremental Forming (SPIF), a variant of ISF, is a method for single sided forming of sheet material (typically metal) without the need for any dies. Prior examples of SPIF embody a number of different implementations. One of the simplest implementations of SPIF comprises a rigid clamping mechanism for restraining a sheet metal work piece along all of its outer four edges while a single forming tool or roller punch is located on one side of the sheet metal. Following designated trajectories, the tool presses on the clamped sheet metal to form the desired shape. Emmens et al, supra, section 2.2 and FIG. 4, referencing Iseki et al. Flexible and Incremental Sheet Metal Forming using a Spherical Roller; Proc. $40^{th}$ JJCYP (1989 pp. 41-44).

Two Point Incremental Forming (TPIF), also known as dual sided incremental forming, is another variation of ISF in which sheet material generally is clamped at its outer edges and force is applied from each side of the sheet material. One example of a dual sided forming method uses two opposed rigid forming tools moving along either side of a work piece to apply force and counter force. In U.S. Pat. No. 8,302,442, sheet fixture assembly 20 (assembly of clamps supports work piece 12 while forming tools 32 and 32" exert dual sided force on work piece 12. The tools may be located directly opposite each other or offset relative to each other. Additionally, each forming tool may be mounted on a 6-axis platform allowing movement in 3-translational directions and 3-rotational axes. (See also, U.S. Pat. Nos. 8,783,078; 8,773,143 and 8,322,176). While somewhat exerting better control over the work piece than SP IF techniques, a loss of formation speed and an additional level of complexity and accuracy is required to coordinate the paths of each opposed forming tool by controller 26 and form work piece 12 into the desired configuration. There, however, remains the difficulty in precisely controlling the opposed tool positioning during the formation process leading to defects such as wrinkles and tearing in the resulting work piece configuration.

In another example of dual sided forming, a rigid tool is located on one side of a work piece, and instead of a second rigid tool on the other side, a single die is located on the other side. As seen in JP Patent 10-314855 (Ueno et. al), die 3 is fixed in position and tool 5 presses work piece 4 toward die 3. While tool 5 is relatively universal in this example, die 3 must be manufactured specifically for each different desired configuration, thus retaining the challenges associated with the manufacturing lead-time and the cost of using any die.

A further example of a dual sided forming method is seen in U.S. Pat. No. 7,536,892. Clamp fixture 1 is arranged for clamping the circumference of work piece W. Die 2 and tool 4 sequentially advance toward each other to press work piece W into the shape corresponding to die 2. The presence of die 2, however, retains the disadvantageously long lead-time and costs inherent with using any die.

Another example of a dual sided forming method is seen in U.S. Pat. No. 6,151,938. Press 2, comprising a plurality of punch elements, is located on one side of blank material 3 while elastomer 4 is positioned on the other side and is in face-contact with blank material 3. Control unit 5 moves the punch elements only along one axis toward their intended positions thus applying force on blank material 3. Elastomer 4 generates a repulsive force supporting blank 3. In the case of a formed product that is long, blank material 3 can be longitudinally moved, whereby the forming process is performed step by step along the length of the blank. The process also is mechanically complex due to the use of many punch elements that form the blank. This punch process also is limited to producing relatively simple shapes.

In another example, U.S. Pat. No. 3,342,051 describes a revolving dual sided ISF device and method in which blank 6 is fully fastened between two clamping rings 3 and 4 that freely slide on guide pins 5 in the direction of one axis perpendicular to the plane of blank 6. In turn, guide pins 5 are attached to backing plate 1 that revolves with turntable 1' (not shown). Deforming tool 7 or a rotating ball 8 is positioned on one side of blank 6 and resilient material 2 is positioned on the opposite side and attached to backing material 1. As blank 6 rotates with resilient material 2 and turntable 1', deforming tool 7 is fed cross-wise along one axis, traversing from the outer edge of blank 6 toward its center in spiral revolutions. Deforming tool 7 is brought to bear against blank 6 along an axis perpendicular to the plane of blank 6 so as to deform blank 6 into the desired configuration always having circular cross-sections. Because deforming tool 7 and turntable 1' respectively move only in two linear axes and one rotational axis, this forming method disadvantageously is limited to producing a "figure of revolution" containing only circular cross-sectional shapes. The '051 device, thus, is neither capable of independent linear movement in 3 axes (i.e., X, Y and Z axes) nor of forming asymmetric shapes, as can be achieved by the present invention.

In contrast, the present invention preferably is directed to dual sided incremental sheet forming apparatus and methods without using purpose-built dies, but rather with unique tooling and movement that can be applied universally to form a variety of shapes with a minimal amount of force.

The present invention preferably includes a primary rigid tool and a secondary tool having a compressible and resilient layer of material. A work piece consisting of a sheet material is positioned between the opposed tools. The primary rigid tool applies force to one surface of the sheet material while the secondary resilient tool applies a controlled counter force to the opposite surface of the sheet material. This dual sided process localizes the forces on the sheet material in an area of contact on the work piece in between the opposed tools (rather than the broadly applied forces and resulting overall stresses exerted upon the entire sheet material while using only a rigid tool on one side of the sheet material). By localizing the forces on the sheet material to the area of contact, stresses and ultimately formation also are localized and are more accurately and precisely controlled in accordance with the present invention when compared to single point incremental sheet forming.

Moreover, by utilizing a primary rigid tool positioned on one side of a work piece in conjunction with an opposed secondary resilient tool, both having linear independent motion (rather than using two opposed rigid tools as found in many previous dual sided techniques), the present invention avoids potential wrinkling and tearing of the resulting work piece. The unique dual sided formation process and apparatus of the present invention, thus, produces numerous asymmetric and more accurately formed products by a simpler and better controlled process, and ultimately uses less power than single or other dual sided incremental sheet forming methods.

SUMMARY

In accordance an aspect of the present invention, an apparatus is described for incrementally forming a work piece (See e.g., FIGS. 1A-C, 2A-C, 3A-C, 4A-B and 5). The work piece has first and second opposed and parallel surfaces, a working area for forming the work piece, and defines a reference plane that is parallel to the surfaces. The apparatus includes a primary forming tool assembly positioned adjacent to and facing the first surface of the work piece and capable of moving into and out of engagement with the work piece in a direction perpendicular to the reference plane and in all directions parallel to the reference plane. The primary forming tool assembly may have a forming tip for forming the work piece. The tip is positioned toward so as to face the first surface of the work piece. The apparatus also includes a secondary forming tool assembly having a resilient surface portion or layer of material facing the second surface of the work piece and capable of moving into and out of engagement with the work piece in a direction perpendicular to the reference plane.

One or both of the work piece and the primary forming tool assembly move relative to each other are capable of being moved to position the primary forming tool assembly within the working area; and exerting force on the first surface of the work piece in the direction perpendicular to the reference plane while the resilient secondary forming tool assembly is engaged with the work piece and exerts a counter force to support the second surface of the work piece such that a localized force is exerted on the work piece while being formed.

In accordance with an aspect of the invention, the above apparatus may also include a sheet feeding assembly (See e.g., FIGS. 1A-C). The sheet feeding assembly includes a sheet feeding roller assembly having at least one set of rollers that contact respective first and second surfaces of the work piece. The set of rollers are capable of moving the work piece in a direction parallel to the reference plane.

Alternatively, the above sheet feeding assembly includes a sheet feeding belt assembly having at least one continuous belt that surrounds and contacts a set of rotatable rollers (See e.g., FIGS. 2A-C). The belt is positioned in contacting relation with the first or second surfaces of the work piece and is capable of moving the work piece in a direction parallel to the reference plane.

Instead, the above sheet feeding assembly may include a sheet fixture assembly having a rigid frame and a retainer capable of securely retaining the work piece therebetween (See e.g., FIGS. 3A-C, 4A-C, and 5). The sheet fixture assembly defines an opening for access to the work piece by the primary forming tool assembly on the first surface of the work piece and by the secondary forming tool assembly on the second surface of the work piece.

In accordance with another aspect of the invention, an apparatus is described for forming a work piece of sheet material. This work piece has first and second opposed and parallel surfaces and defining a reference plane that is parallel to the first and second surfaces of the work piece. The apparatus includes a sheet feeding assembly capable of moving the work piece in a direction parallel to the reference plane. The apparatus also includes a primary forming tool assembly positioned to face the first surface of the work piece and capable of moving in a first direction perpendicular to the reference plane and in a second direction which is both parallel to the reference plane and perpendicular to the direction of movement of the work piece by the sheet feeding assembly.

The apparatus further includes a backing roller tool assembly capable of moving in a direction perpendicular to the reference plane and having an elongated cylindrical configuration for rotating about its longitudinal axis which is positioned parallel to the second direction of movement of the primary forming tool assembly. The backing roller tool is comprised of an inner core and an outer resilient layer secured thereto which is positioned to face the second surface of the work piece. Alternatively, the backing roller tool assembly may have an outer surface, a portion of which is compressible when a force is applied thereto yet resiliently returning to its non-compressed configuration when the force is removed (See e.g., FIGS. 1A-C, 2A-C and 3A-C).

The primary forming tool assembly and the backing roller tool assembly are capable of being in simultaneous contact with respective first and second opposed surfaces of the work piece generally opposite each other while the primary forming tool assembly exerts force on the first surface of the work piece to form the work piece and the backing roller tool assembly exerts a counter force on the second surface of the work piece while the work piece is being formed by which the process creates a localized force on the work piece.

In accordance with a further aspect of the invention, an apparatus is described for forming a sheet material work piece into a predetermined configuration. The work piece has first and second opposed and parallel surfaces and defines a reference plane that is parallel to the surfaces of the work piece. The apparatus includes a backing roller tool assembly capable of rotating about its longitudinal axis and having an inner core and an outer resilient layer secured thereto or an outer surface portion. Along its longitudinal axis, the backing roller assembly faces the second surface of the work piece and is parallel to the reference plane (See e.g., FIGS. 1A-C, 2A-C and 3A-C).

The apparatus also includes a primary forming tool assembly positioned adjacent to and facing the first surface of the work piece. The primary forming tool assembly is capable of exerting a force on the first surface of the work piece to form the work piece locally while moving in a first direction parallel to the longitudinal axis of the backing roller assembly. The apparatus also includes a sheet fixture assembly having a rigid frame and a retainer capable securely retaining the work piece therein. The sheet fixture assembly is positioned parallel to the reference plane and defines an opening for access to the work piece by the primary forming tool assembly on the first surface of the work piece and by the secondary forming tool assembly on the second surface of the work piece.

The primary forming tool assembly and the backing roller tool assembly are capable of moving in a direction perpendicular to the reference plane so as to contact respective first and second surfaces of the work piece. As a result, the force exerted by the primary forming tool assembly on the first surface of the work piece is offset by a counter force exerted on the second surface of the work piece by the backing roller tool assembly thereby to support the work piece in an area localized to the primary forming tool while the work piece undergoes formation.

In accordance with an additional aspect of the invention, another apparatus is described for incrementally forming a work piece (See e.g., FIGS. 1A-C, 2A-C, 3A-C, 4A-B and 5). The work piece has first and second opposed surfaces positioned on an X-Y plane of an "X", "Y", "Z" three-dimensional coordinate system. The apparatus includes a primary forming tool assembly positioned adjacent to and facing the first surface of the work piece. The apparatus also includes a secondary forming tool assembly having a rigid body and a compressible and resilient layer of material secured thereto and positioned adjacent to and facing the second surface of the work piece.

The work piece, the primary forming tool assembly and the secondary tool assembly are capable of independently moving in a predetermined sequence and pattern relative to each other along at least one of the X, Y or Z axes of the coordinate system. The primary forming tool assembly and the work piece also are capable of moving relative to each other along the X, Y and Z axes. The secondary forming tool assembly is capable of moving along the Z-axis relative to the work piece. As a result, the primary forming tool assembly is capable of exerting force on the first surface of the work piece. The secondary forming tool assembly also is capable of exerting a counter force along the Z-axis against the second surface of the work piece thereby locally supporting the work piece. During the forming process, the forming force is substantially localized at the area of contact with the primary forming tool and work piece (See e.g., FIG. 10).

In accordance with a further aspect of the invention, an above apparatus includes a control system capable of simultaneously coordinating the respective movements of the work piece, the primary forming tool assembly and the secondary forming tool assembly in relation to each other. The coordinated movements of these components cause the primary forming tool assembly to follow a predetermined path along the first surface of the work piece while the secondary forming tool assembly simultaneously follows the same path along the second surface of the work piece.

In another aspect of invention, a method is described for incrementally forming a work piece having at least one work area and having first and second opposed and parallel surfaces positioned on an X-Y plane of an "X", "Y", "Z" three-dimensional orthogonal coordinate system. (See e.g., FIG. 7) The method comprises providing an apparatus having a primary forming tool assembly positioned adjacent to and facing the first surface of the work piece; and a backing forming tool assembly having a compressible and resilient surface portion that is positioned adjacent to and facing the second surface of the work piece. The work piece, the primary forming tool assembly and the backing forming tool assembly are capable of independently moving in a predetermined sequence and pattern relative to each other.

The primary forming tool assembly is positioned relative to the work piece to move simultaneously to a predetermined X, Y, Z coordinate so as to be adjacent to the first surface of the work piece within the work area. The backing forming tool assembly is positioned relative to the work piece so as to move simultaneously to a predetermined Z coordinate within the work area so as to be in contact with the second surface of the work piece and opposite the position of the primary forming tool assembly. The primary forming tool assembly advances toward the work piece in the Z direction to a predetermined Z coordinate so as to contact and exert a force on the first surface of the work piece at a point of contact within the work area. As a result, the work piece forms into a predetermined configuration and the resilient backing forming tool assembly compresses to support the second surface of the work piece while being formed.

The primary forming tool assembly moves relative to the work piece on an X-Y plane (See e.g., FIG. 7) along a predetermined set of coordinates thereby following a predetermined path along which the work piece is consistently formed in the Z direction within the work area. The primary forming tool assembly retracts away from the work piece in the Z direction and repositions on an X-Y plane to a predetermined set of coordinates adjacent the first surface of the work piece. The above steps may be repeated by sequentially utilizing incrementally progressing values for the Z coordinates until the work piece is fully formed in the work area.

In another aspect of the present invention, the apparatus of the above method further includes a control system having a controller assembly and a non-contact or a contact sensor. With the sensor(s), the controller assembly simultaneously measures the amount of formation of the work piece at specified positions along its path of formation. The resulting measurements are compared to a predetermined amount of formation of the work piece at the same specified positions along the path of formation. The resulting compared measurements are relayed to the controller assembly. The controller assembly then adjusts the position of at least one of the primary forming tool assembly and the backing forming tool assembly relative to the preprogrammed amounts of required formation along the path so as to form the work piece into the predetermined shape.

Another aspect of the invention is directed to a method for incrementally forming a work piece having at least first and second work areas that are separated from each other and having first and second opposed and parallel surfaces positioned on an X-Y plane of an "X", "Y", "Z" three-dimensional orthogonal coordinate system (See e.g., FIGS. 8A-B). The method comprises providing an apparatus having a primary forming tool assembly positioned adjacent to and facing the first surface of the work piece and a backing forming tool assembly having a compressible and resilient surface portion and being positioned adjacent to and facing the second surface of the work piece. The work piece, the primary forming tool assembly and the backing forming tool assembly are capable of independently moving in a predetermined sequence and pattern relative to each other.

The primary forming tool assembly is positioned relative to the work piece to move simultaneously to a predetermined X, Y, Z coordinate so as to be adjacent to the first surface of the work piece within the first work area. The resilient backing forming tool assembly is positioned relative to the work piece at a predetermined Z coordinate within the first work area so as to be in contact with the second surface of the work piece and opposite the position of the primary forming tool assembly. The primary forming tool assembly advances toward the work piece in the Z direction to a predetermined Z coordinate so as to contact and exert force on the first surface of the work piece within the first work area at a point of contact.

As a result, the work piece forms into a predetermined configuration and the resilient surface portion of the backing forming tool assembly compresses to support the second surface of the work piece resulting in localized on the work piece while being formed. The primary forming tool assembly moves relative to the work piece on an X-Y plane along a predetermined set of coordinates having substantially the same Z coordinate thereby following a predetermined path along which the work piece is consistently formed in the Z direction in the first work area. The primary forming tool assembly retracts away from the work piece in the Z direction and repositions on an X-Y plane at a predetermined set of coordinates within the second work area adjacent to the first surface of the work piece.

The primary forming tool assembly advances toward the work piece in the Z direction within the second work area to the same Z coordinate as was selected for the first work area so as to contact and exert a localized force on the first surface of the work piece at a point of contact. As a result, the work piece forms into a predetermined configuration and the resilient surface portion of the secondary forming tool assembly compresses to support the second surface of the work piece while being formed. The primary forming tool assembly moves relative to the work piece on an X-Y plane along a predetermined set of coordinates which are substantially the same in the Z direction thereby following a predetermined path along which the work piece is consistently formed in the Z direction in the second work area. The primary forming tool assembly retracts away from the work piece in the Z direction. The above steps may be repeated by sequentially utilizing incrementally progressing values for the Z coordinates until the work piece is fully formed in each work area.

According to a further aspect of the invention, a method is described for incrementally forming at least one work area of a work piece initially having a generally flat configuration and first and second opposed surfaces positioned on an X-Y plane of an "X", "Y", "Z" three-dimensional orthogonal coordinate system (See e.g., FIGS. 7 and 8). In accordance with the method, a primary forming tool assembly is positioned adjacent to the first surface of the work piece. The primary forming tool assembly has a tip capable of forming the work piece when forcibly engaged therewith, the tip having a hardness value that is greater than that of the work piece.

A backing roller tool assembly is positioned adjacent to the second surface of the work piece. The backing roller tool assembly is capable of being moved in the Z direction. The backing roller tool assembly further has a compressible and resilient outer surface portion, at least one of the backing roller tool assembly and the outer resilient surface portion being rotatable about a longitudinal axis extending through the center of the backing roller tool assembly. The backing roller tool assembly advances toward the work piece along the Z-axis to contact and support the second surface of the work piece.

The primary forming tool assembly advances along the Z-axis relative to the work piece for the tip to engage the first surface of the work piece and provide a predetermined amount of forming force thereon to form the work piece. The position of the backing roller tool assembly is maintained to provide sufficient reactive force on the second surface of the work piece. The sufficiency of the reactive force being determined by the degree of compressibility and resiliency of the outer surface portion of the backing roller tool assembly.

The primary forming tool assembly is moved relative to the work piece on the X-Y plane along a predetermined set of coordinates having substantially the same Z coordinate so as to follow a predetermined path along which the work piece is consistently formed in the Z direction The backing roller tool assembly continuously moves in tandem with the movement of the primary forming tool assembly to remain substantially opposite the tip of the primary forming tool assembly with the work piece therebetween, thereby maintaining localized force on the work piece. The primary forming tool assembly and said backing roller tool assembly retract from the work piece. The above steps may be repeated successively within one or more additional work areas of the work piece until the work piece is formed into the pre-programmed and predetermined final configuration.

BRIEF DESCRIPTION OF THE DRAWINGS

FIG. 1A depicts an exemplary axonometric view of Embodiment 1;

FIG. 1B depicts an exemplary front section view of Embodiment 1;

FIG. 1C depicts an exemplary side section view of Embodiment 1; and

FIG. 1D depicts an exemplary partial side section view illustrating an alternate backing roller tool assembly of Embodiment 1.

FIG. 2A depicts an exemplary axonometric view of Embodiment 2;

FIG. 2B depicts an exemplary front section view of Embodiment 2; and

FIG. 2C depicts an exemplary side section view of Embodiment 2.

FIG. 3A depicts an exemplary axonometric view of Embodiment 3;

FIG. 3B depicts an exemplary front section view of Embodiment 3; and

FIG. 3C depicts an exemplary side section view of Embodiment 3.

FIG. 4A depicts an exemplary axonometric view of Embodiment 4; and

FIG. 8A is an exemplary top view of a work piece that is being formed in multiple locations in accordance with embodiments of the present invention.

FIG. 9A depicts a primary forming tool made of a single component;

FIG. 9B depicts a primary forming tool made of a separate shaft and tip; and FIG. 9C depicts a primary forming tool made of a separate shaft, tip, and bearing.

DETAILED DESCRIPTION

The present invention is directed to a unique dual sided incremental sheet forming apparatus and method without using purpose-built dies, but rather with tooling that can be applied universally to form a variety of shapes with a minimal amount of force.

By way of illustration only, the present invention is applicable to the formation of parts and components from sheet materials for all major industries such as automotive, aerospace, industrial, architectural, engineering, construction and consumer products.

Figure 1A:
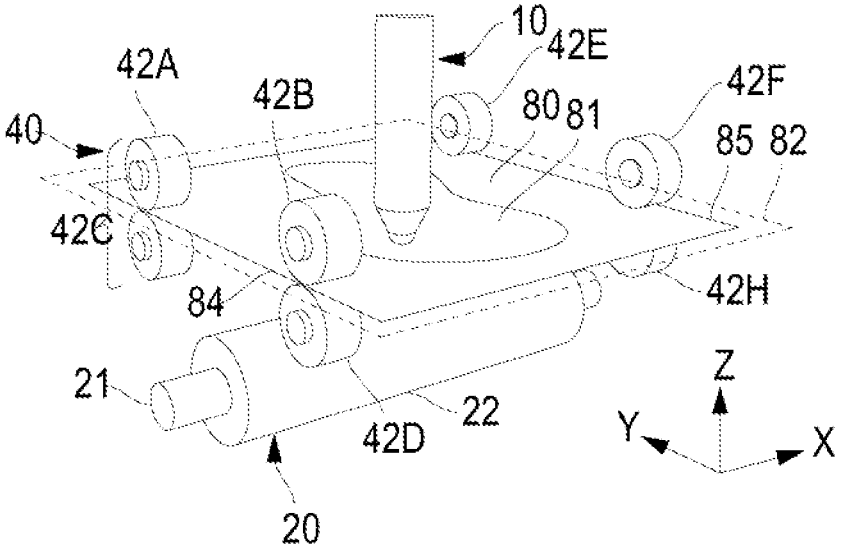
FIGS. 1A-D depict a first embodiment (Embodiment 1) of the present ISI' system having a sheet feeding roller assembly for advancing a work piece, a primary forming tool assembly and a secondary forming tool assembly. In particular.
Figure 1B:
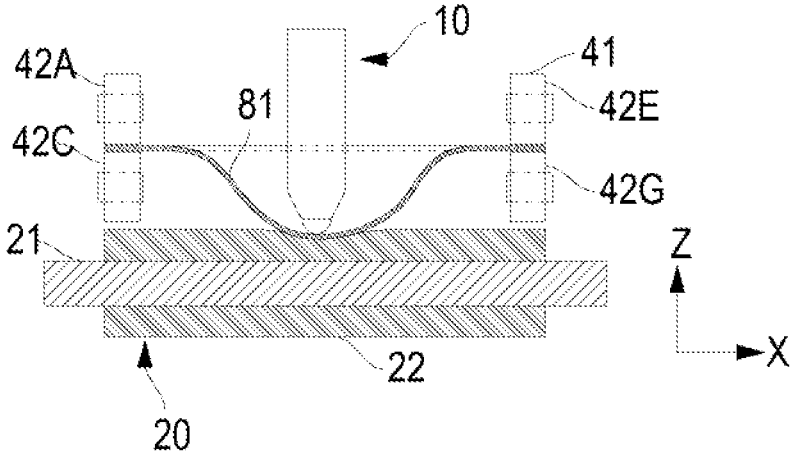
Figure 1C:
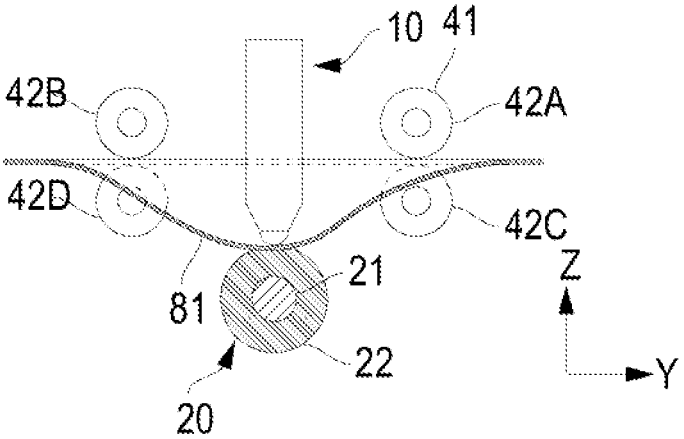

FIGS. 1A, 1B, and 1C depict a first embodiment (Embodiment 1) of an inventive incremental sheet forming (ISF) system. This system comprises sheet feeding roller assembly 40 for precisely advancing work piece 80, primary forming tool assembly 10 and a secondary forming tool assembly (e.g., backing roller tool assembly 20).

In FIG. 1A, work piece 80 is shown formed into its final shape 81. Work piece 80 comprises a sheet of material (e.g., sheet metal) that may be made of steel, aluminum, plastic or another formable material. This sheet of material usually begins in a flat state shown in Embodiment 1 as parallel to a reference plane. The reference plane is depicted as X-Y plane 82 and is defined by the initial configuration of work piece 80 prior to incrementally forming the work piece. The sheet may also be pre-formed with certain preliminary features prior to conducting additional operations in accordance with the present invention.

Sheet feeding roller assembly 40 comprises one or more sets of synchronized rollers 42 (42A-42H) that are positioned to contact work piece 80. Synchronized rollers 42 contact each opposed surface of work piece 80 typically along first and second edges (or marginal edges portions) 88 or 89. However, other engagement surface portions are contemplated.

Sheet feeding roller assembly 40 advances work piece 80 back and forth preferably along one axis, shown as the Y-axis in FIG. 1A. In Embodiment 1, sheet feeding roller assembly 40 comprises four sets of synchronized rollers 42. Two sets rollers (42A-42B and 42C-42D) are positioned along first edge 88 of work piece 80, and two sets (42E-42F and 42G-42H) are positioned along second edge 89 of the work piece. A first set of these rollers is positioned to contact a surface of work piece 80, and a second set of these rollers is positioned to contact the opposite surface of work piece 80.

As shown in FIG. 1A, opposed pairs of rollers (e.g., 42A and 42B with 42C and 42D; 42E and 42F with 42G (not shown) and 42H) preferably are positioned directly opposite each other in contact with the opposed surfaces of work piece 80. These rollers preferably contact and grip opposed surfaces of work piece 80 along edges 88 or 89 to drive the work piece along the Y-axis.

At least one of rollers (42A-42D) on first edge 88 and at least one of rollers (42E-42H) on second edge 88 interface with motor(s), control systems and software (not shown) to coordinate and synchronize the rotation of the rollers. As a result, the rollers precisely move work piece 80 to a desired location, preferably along one translational axis (Y-axis). See also motor actuation description with respect to FIGS. 6A-D, in which in FIG. 1A-C the same motor control system can be utilized.

Synchronized rollers 42 preferably comprise a base core that is made of steel, aluminum or another suitable material and may additionally have at their circumference a coating or layer of polyurethane, neoprene, rubber or another suitable material that is sufficiently flexible and resilient to enhance positive gripping of work piece 80.

In FIGS. 1A-C, primary forming tool assembly 10 is positioned adjacent one surface of work piece 80 to engage the first (i.e., upper) surface of the work piece and to move in a direction transverse to the movement of the work piece, as shown in Embodiment 1 along the X-axis. Thus, this movement of primary forming tool assembly 10 is perpendicular to the direction in which work piece 80 moves (along Y-axis) as driven by sheet feeding roller assembly 40. Primary forming tool assembly 10 also moves in a direction perpendicular to X-Y reference plane 82 of work piece 80, which is shown in Embodiment 1 as the Z-axis, so as to be able to move into and out of contact with the first (i.e. upper) surface of the work piece.

The secondary forming tool assembly comprises backing roller tool assembly 20 having preferably solid core 21 and having an outer flexible, compressible or resilient material (or surface portion of backing roller tool) layer 22 that is secured to the circumference of core 21 to provide flexible, compressible, resilient and controlled counter force on the second or lower surface of work piece 80 as primary forming tool assembly 10 engages the opposite (i.e., first or upper) surface of the work piece.

In Embodiment 1 (See e.g. FIGS. 1A, B, and C), backing roller tool assembly 20 is positioned adjacent to and facing the surface of work piece 80 that is opposite to that of primary forming tool assembly 10. Thus, work piece 80 separates backing roller tool assembly 20 from primary forming tool assembly 10. Backing roller tool assembly 20 is elongated, cylindrical and has a longitudinal axis of rotation extending longitudinally therethrough that is positioned along the X-axis, parallel to a direction of movement of primary forming tool assembly 10 and in contact with the opposite (i.e., lower) surface of work piece 80.

The tip of primary forming tool assembly 10 and the longitudinal axis of backing roller tool assembly 20 preferably are positioned directly opposite so as to face toward each other on either side of work piece 80 along the X-axis. Preferably, the length of backing roller tool assembly 20 is approximately at least substantially the same or longer than the distance primary forming assembly tool 10 is permitted to travel along the X-axis. As a result, backing roller tool assembly 20 remains in formable and direct contact with the second (i.e., lower) surface of work piece 80 as the primary forming toll assembly 10 engages the first (i.e., upper) surface of the work piece and moves along the X-axis.

Figure 2A:
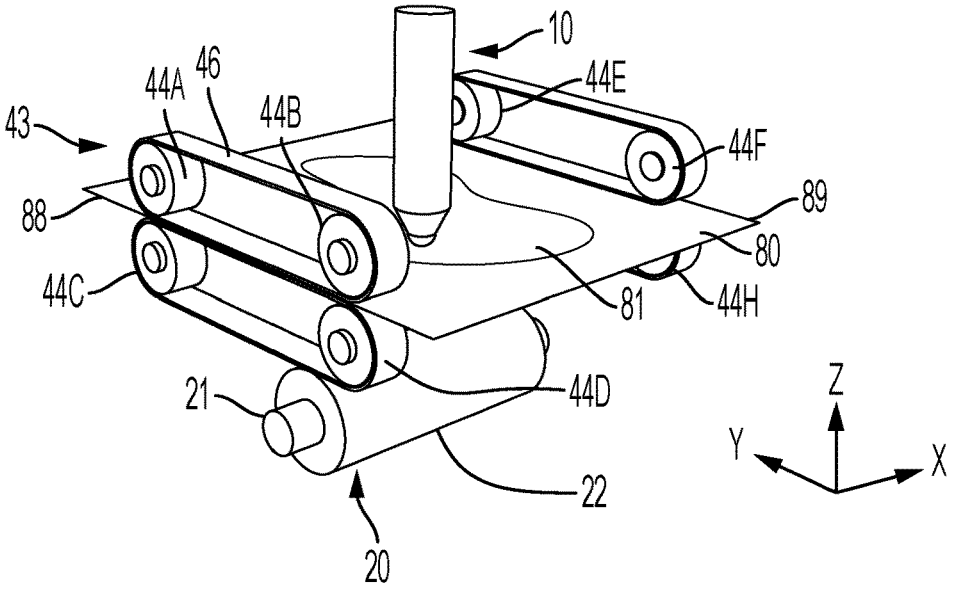
FIGS. 2A-C depict a second embodiment (Embodiment 2) of the present ISF system with a sheet feeding belt assembly for advancing a work piece, a primary forming tool assembly and a secondary forming tool assembly. In particular.
Figure 3A:
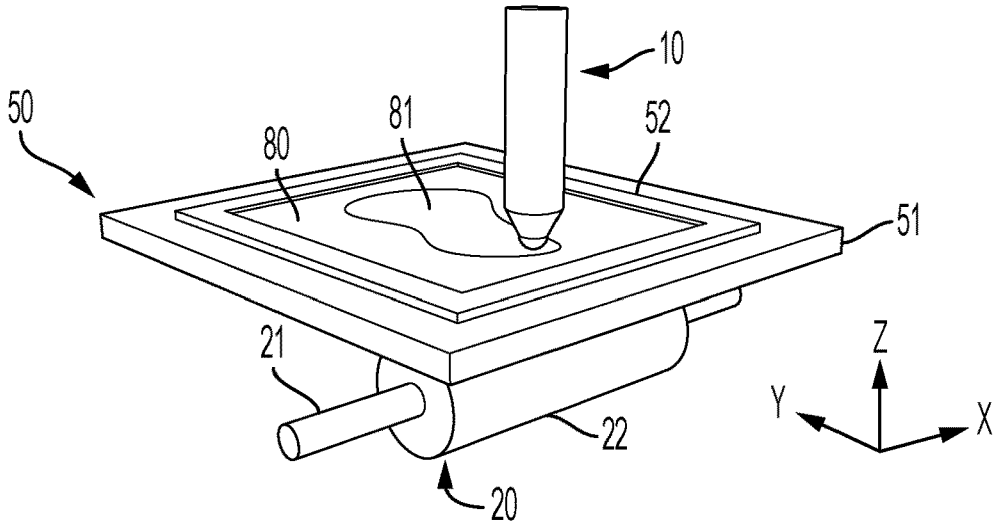
FIGS. 3A-C depict a third embodiment (Embodiment 3) of the present ISF system with a movable frame assembly for advancing a work piece, a primary forming tool assembly and a secondary forming tool assembly. In particular.

In FIGS. 1A, 2A and 3A, backing roller tool assembly 20 is shown to be positioned away from and not in direct contact with work piece 80 only for illustration purposes. During operation of the inventive apparatus, resilient layer 22 of backing roller tool assembly 20 actually is positioned to face toward and be in direct engagement with the second (i.e., lower) surface of work piece 80. When primary forming tool assembly 10 engages and applies force on the first or opposite surface of the work piece 80 the result is a localized force in the area in which the primary forming tool assembly 10 contacts the work piece 80.

Primary forming tool assembly 10 and resilient layer 22 of backing roller tool assembly 20 are actually positioned to provide force which oppose each other at their points of contact along the X-axis, with work piece 80 positioned there between. More specifically, primary forming tool assembly 10 and resilient layer 22 are in indirect contact through the formed work piece 80 by virtue of the force applied to the first (i.e., upper) surface of the work piece by primary forming tool assembly 10 and the counter force applied to the opposite or second (i.e., lower) surface of the work piece by the controlled compression of flexible and resilient layer 22 of backing tool roller assembly 20. The amount of counter force is controlled by the degree of hardness, thickness and resulting compressibility and resiliency of resilient layer 22 (or the outer surface portion) of backing roller tool assembly 20.

In addition to rotating along its longitudinal axis, backing roller tool assembly 20 also moves in a direction perpendicular to X-Y reference plane 82 of work piece 80, shown in Embodiment 1 as the Z-axis. Movement along the Z-axis permits backing roller tool assembly 20 to remain in contact with work piece 80 as primary forming tool assembly 10 exerts precisely controlled opposed forces on the work piece.

More specifically, as seen in FIGS. 1B and C, backing roller tool assembly 20 including resilient layer 22 is positioned along its longitudinal axis on the X-axis to come in contact with the lower surface (i.e., second surface) of work piece 80 thus causing the creation of a continuous narrow zone of contact points along the X-axis. More specifically, this zone of contact occurs where the circumference of resilient layer 22 intersects the lower surface of work piece 80. In other words, when resilient layer 22 and the lower surface of work piece 80 are in contact with each other, a narrow area or zone of contact is created there between. This zone occurs at the tangent of the circumference of resilient layer 22 with the lower surface of the work piece. Simultaneously, primary forming tool assembly 10 is positioned along the X-axis, facing the upper surface of the work piece and opposite the zone of contact of resilient layer 22 with the lower surface of work piece 80.

As primary forming tool assembly 10 bears down on the first surface of work piece 80, it exerts force on the work piece at a given area of contact along the X-axis. Work piece 80 in turn exerts force on resilient layer 22 at an imposed area along the narrow zone of contact along the X-axis. As a result, resilient layer 22 is compressed and exerts a counter force at an opposed localized area along the narrow zone of contact with work piece 80 on the X-axis. With both primary forming tool 10 and resilient layer 22 exerting force on opposite sides of work piece 80, the forces are substantially concentrated at the area of contact between primary forming tool 10 and work piece 80. At this contact area or "zone of tangency", the force exerted by work piece 80 on the resilient layer 22 advantageously remains concentrated and localized because of the cylindrical shape of resilient layer 22, thus avoiding warping and tearing of the resulting work piece. As a result, the apparatus of Embodiment 1 is capable of creating numerous dimensionally complex and asymmetric configurations on work piece 80 as intended by a selected control system at any given time during operation (See e.g., FIG. 10).

Moreover, backing roller tool assembly 20 has a cylindrical configuration for rotating on its longitudinal axis. When it is positioned perpendicular (i.e., X-axis) to the direction of movement of the work (i.e., Y-axis), backing roller tool assembly 20 advantageously permits precise and speedy positioning of work piece 80. The cylindrical configuration of backing roller tool assembly 20 also advantageously allows for a simpler and more compact design of the apparatus itself over many previous ISF devices.

Figure 1D:
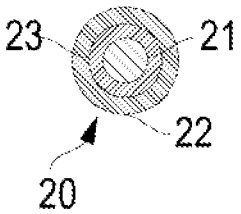

In Embodiment 1, core 21 is a solid rod. Outer resilient layer 22 of backing roller tool assembly 20 is secured thereto and freely rotate together about their longitudinal axis. Resilient layer 22 may be secured by being rigidly affixed or fixedly attached to core 21 or alternatively secured by circumferentially surrounding the core yet being capable of freely rotating about the core. For example, resilient layer 22 may be made of multiple materials or layers so that it may freely rotate by way of a bearing assembly 23 (e.g, plain bearings) positioned around core 21 as known in the art. In other words, and as depicted in FIG. 1D. resilient layer 22 may be circumferentially secured to inner core 21 by bearing assembly 23, thereby facilitating movement of outer resilient layer 22 relative to inner core 21. In another embodiment, core 21 may be a hollow tube or cylinder that freely rotate together with resilient layer 22 about a bearing assembly. In another alternative embodiment, the core 21 may be fixed (i.e., non-rotatable) while resilient layer 22 is capable freely rotating freely around it. In an alternative embodiment, the rotation of backing roller tool assembly 20 may be controlled by either mechanical or electromechanical means known in the art. In a further aspect backing roller tool assembly 20 includes a compressible and resilient layer 22, and at least one of the backing roller tool assembly and the outer resilient surface portion are rotatable about an axis extending through the center of the backing roller tool assembly.

Preferably, the longitudinal axis of backing roller tool assembly 20 is movably positioned so that resilient layer 22 may remain in continuous contact with a surface of work piece 80 along the X-axis. Being in contact with work piece 80 also causes backing roller tool assembly 20 to rotate by engagement with work piece 80 as the work piece moves along the Y-axis by the action of sheet feeding roller assembly 40.

Rigid core 21 may preferably be constructed of steel, aluminum or another suitable material. Core 21 may be either solid or hollow depending on size and configuration.

Resilient layer 22 is preferably made of a resilient, formable material having a compression strength to enable the material to be formed under the force applied on work piece 80 by primary forming tool assembly 10. The material selected for resilient layer 22 also is capable of substantially returning to its original or non-compressed shape as the force from the primary forming tool assembly 10 onto work piece 80 is removed. For example, resilient layer 22 may be made of an elastomer, preferably polyurethane. Alternatively, it may also be made of rubber, neoprene, nitrile or another suitable material that is capable of precise, predictable, controlled deformation and resilience when contact is made with work piece 80.

Resilient layer 22 generally has hardness durometer ranging from about a Shore 10A about 80D, preferably about 30A to about 95A. Depending on the hardness of the material selected, the thickness of resilient layer 22 may vary between about 0.01 mm and about 25 mm, preferably about 1.0 mm to about 5.0 mm. By selecting a preferred durometer for resilient layer 22, a precise and controlled counter force may be applied to the second surface of work piece 80 when primary forming tool assembly 10 exerts force on the first surface of the work piece.

During the forming process, sheet feeding roller assembly 40 is operative to move work piece 80 back and forth along the Y-axis into its desired location. Primary forming tool assembly 10 is simultaneously capable of moving along the X-axis to a desired location. Backing roller tool assembly 20 is simultaneously capable of moving along the Z-axis to a desired location to be in contact with the surface of work piece 80. When brought in contact with work piece 80, backing roller tool assembly 20 preferably is free to rotate along its longitudinal axis by frictional engagement with the work piece, as sheet feeding roller assembly 40 moves the work piece to its desired position along the Y-axis.

Sheet feeding roller assembly 40, primary forming tool assembly 10 and backing roller tool assembly 20 may be controlled by different systems (e.g., mechanical, hydraulic) that may interface directly or indirectly with each other and computing entities to send and receive information regarding their precise positioning at their desired locations. See also motor actuation description with respect to FIGS. 6A-D and FIG. 9 and the control system with regard to FIG. 10, in which similar motors, control systems and software can be utilized in the arrangement of FIGS. 1A-C.

When work piece 80, primary forming tool assembly 10, and backing roller tool assembly 20 move independently to their specified and coordinated positions, primary forming tool assembly 10 can be brought to bear against work piece 80 by movement along the Z-axis, which is perpendicular to the original X-Y reference plane 82 of the work piece. Simultaneously, backing roller tool assembly 20 can be moved along the Z-axis so as to be in deformable and resilient contact along its longitudinal axis (i.e., along the X-axis) with work piece 80.

By primary forming tool assembly 10 applying force to work piece 80, the work piece begins to form locally into its desired configuration at the precise point of contact where the force is applied. More specifically, primary forming tool assembly 10 creates localized force at the area of contact in the X, Y and Z directions as it traverses along its predetermined path relative to work piece 80. As primary forming tool assembly 10 moves relative to work piece 80, the work piece is continuously formed along a force vector having predetermined magnitudes and components in the X, Y and Z directions. This localized force plastically and permanently forms work piece 80 into the desired shape at the area of contact with the work piece where the force is applied.

While primary forming tool assembly 10 exerts force onto one surface of work piece 80, backing roller tool assembly 20 maintains continuous contact with the opposite surface of the work piece. As a result of the force being applied by primary forming tool assembly 10 on work piece 80, resilient layer 22 deforms to create a reactive opposed force capable of supporting the work piece while the work piece is being formed into its desired shape.

As primary forming tool assembly 10 advances along the Z-axis and locally forms work piece 80 into the desired configuration, backing roller tool assembly 20 retreats along the Z-axis to the extent required to adjust for the movement of advancing primary forming tool assembly 10. Preferably, resilient layer 22 remains deformed while moving in precise controlled contact with work piece 80 and generates a counter force that supports the work piece while the backing roller tool assembly is moved along the Z-axis. Due to its resilient nature, resilient layer 22 is selected to be capable of substantially returning to its original configuration once primary forming toll assembly 10 retreats along the Z-axis and sheet feeding roller assembly 40 moves work piece 80 to a new location along the Y-axis.

Once work piece 80 is formed locally to its desired configuration at the selected location, another position for the work piece is chosen for forming the work piece at a new location. Sheet feeding roller assembly 40 then moves work piece 80 to its selected position along the Y-axis in coordination with the required predetermined and preprogrammed independent movement of primary forming tool assembly 10 along the X and Z axes. Furthermore, independent movement of work piece 80 also is coordinated through a control system (not shown) with the specified independent movement of backing roller tool assembly 20 along the Z-axis. As a result, the required formation of work piece 80 at the selected position occurs.

A further coordinate is selected, and the above sequence continues until work piece 80 is fully formed into the desired configuration. See also FIGS. 6-10 and their accompanying descriptions regarding carrying out the inventive process.

Figure 2B:
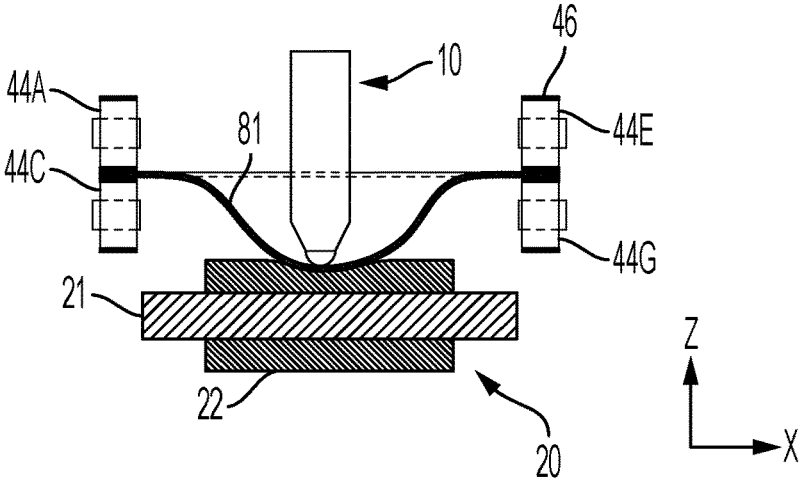
Figure 2C:
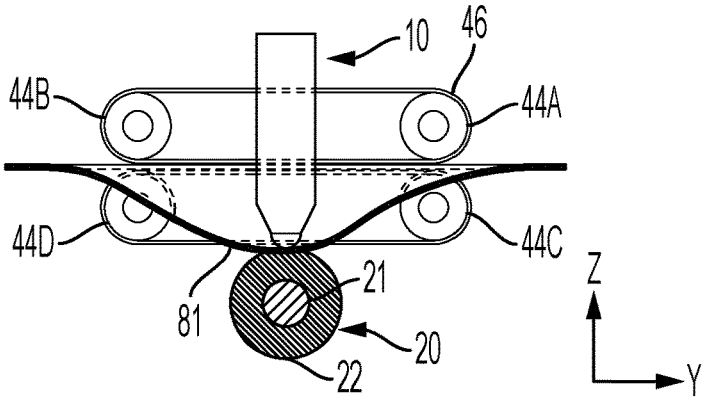

FIGS. 2A-C depict a second embodiment (Embodiment 2) of an inventive sheet forming ISF system. This embodiment comprises a sheet feeding belt assembly 43 for precisely advancing work piece 80, primary forming tool assembly 10 and secondary forming tool assembly (e.g., backing roller tool assembly 20).

In Embodiment 2, sheet feeding roller assembly 40 of Embodiment 1 is replaced with sheet feeding belt assembly 43 and functions in a similar manner to that of the sheet feeding roller assembly. This assembly comprises sets of pulleys 44A-44H and continuous and endless belts 46 that surround the rollers. The sets of rollers rotate in contact with continuous belts 46 for the belts to produce high traction effort along the Y-axis at predetermined speed as pulleys 44 rotate. Consequently, belts 46 precisely grip and move work piece 80 forward and backward preferably along one axis (shown as the Y-axis in Embodiment 2). Belts 46 are configured and dimensioned and are made of a material selected to expand the area of contact with the surface of work piece 80 over that of pulleys of 44A-44H of Embodiment 1. The additional surface area contacted on work piece 80 by sheet feeding belt assembly 43 of Embodiment 2 increases the grip and minimizes possible slippage of the work piece for achieving even more precise positioning of the work piece.

Alternate embodiments are contemplated, for example, in which a plurality of belts are arranged to contact opposed surfaces of work piece 80 at least along edges 88 or 89. Additionally, it is contemplated that there may be as few as one belt 46 in contact with one surface of work piece 80 with pulleys positioned on the opposed surface of the work piece.

Embodiment 2 (See e.g., FIG. 2A) illustrates sheet feeding belt assembly 43 as having four sets of pulleys (44A and 44B, 44C and 44D, 44E and 44F, 44G (not shown) and 44H) and four belts 46. One roller set (44A and 44B) is located and positioned along first edge 88 of work piece 80 and on a first (i.e., upper) surface of the work piece. A second roller set (44C and 44D) is located and positioned at first edge 88 of work piece 80 but on the opposite (i.e., second or lower) surface of the work piece. A third roller set (44E and 44F) is located and positioned along second edge 89 of work piece 80 that is parallel to first edge 88 of the work piece. A fourth roller set (44 (not shown) and 44H)) also is located and positioned at second edge 89 parallel to first edge 88 of work piece 80 but on the opposite surface of the work piece.

As shown, continuous belts 46 surrounds its set of pulleys 44A-44H and contact the surface of work piece 80 along edges 88 and 89 to grip and move work piece 80 to a desired location along the Y direction. Belts 46 preferably are configured and dimensioned to be capable of providing consistent traction on the surfaces of work piece 80 for precise, enabling predictable and coordinated movement of the work piece back and forth along the Y-axis.

At least one of pulleys 44A or 44B and one of pulleys 44E or 44F may preferably be actuated by synchronized motors (not shown) and control systems which coordinate and drive the rotation of the various pulleys and surrounding belts 46 so as to move and position work piece 80 back and forth preferably along one translational axis, shown in Embodiment 2 as the Y-axis. In addition or in the alternative, at least one of pulleys 44C or 44D and one of pulleys 44G or 44H may also preferably be actuated by synchronized motors (not shown) to coordinate and drive the rotation of the various pulleys and surrounding belt so as to grip and move work piece 80 back and forth preferably along one translational axis, shown in Embodiment 2 as the Y-axis.

Pulleys 44 of sheet feeding belt assembly 43 comprise a core that is made of steel, aluminum or another suitable material know in the art. Belts 46 of sheet feeding belt assembly 43 are comprised of urethane, neoprene or another suitable material and preferably are reinforced with strands of fiberglass, aramid, polyamide fiber such as KEVLAR material, carbon, steel or another suitable material known in the art.

Additionally, belts 46 may be coated with a layer of material such as urethane, nitrile, rubber or another suitable material known in the art to increase the coefficient of friction between the belt and work piece 80. The width, thickness and durometer of belts 46 are selected to be able to apply precise and consistent traction on the surface of work piece 80 for coordinated alignment of work piece 80 with primary forming tool assembly 10 and the secondary forming tool assembly.

The operation of Embodiment 2, including primary forming tool assembly 10 and backing roller tool assembly 20, are as described with respect to Embodiment 1, except that the operation of sheet feeding roller assembly 40 of Embodiment 1 is replaced with that of sheet feeding belt assembly 43, as described.

Sheet feeding belt assembly 43, primary forming tool assembly 10 and backing roller tool assembly 20 may be controlled by different systems (e.g., mechanical, hydraulic) that may interface directly or indirectly with each other and computing entities to send and receive information regarding their precise positioning at their desired locations. See also motor actuation description with respect to FIGS. 6A-D and FIG. 9 and the control system with regard to FIG. 10.

Figure 3B:
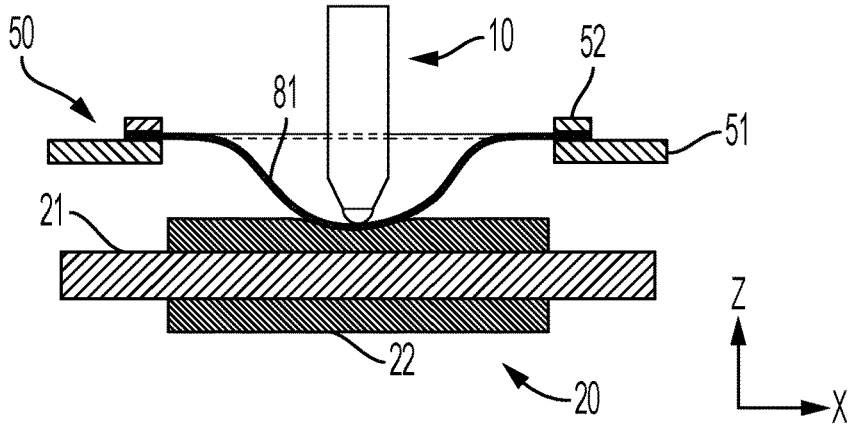
Figure 3C:
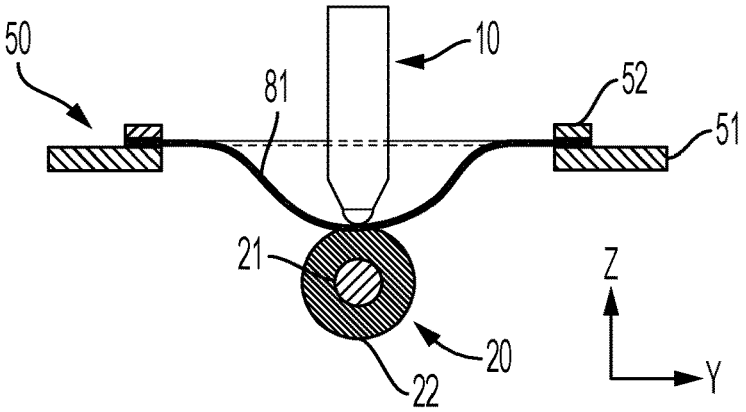

FIGS. 3A-C depict a third embodiment (Embodiment 3) of the present ISF system. This embodiment comprises sheet fixture assembly 50 for advancing work piece 80, primary forming tool assembly 10 and backing roller tool assembly 20.

In Embodiment 3, sheet fixture assembly 50 replaces the sheet feeding roller and sheet feeding belt assemblies of Embodiments 1 and 2. Sheet fixture assembly 50 comprises a rigid frame 51 and a retainer 52. Work piece 80 is positioned and secured between rigid frame 51 and retainer 52 capable of securely restraining the movement of the work piece relative to rigid frame 51. Sheet fixture assembly 50 defines an opening that is configured and dimensioned to receive work piece 80 between rigid frame 51 and retainer 52 yet to permit the work piece to be secured retained by sheet fixture assembly 50 along at least a portion of the periphery of the work piece. In other words, the opening in sheet fixture assembly 50 is defined to provide access to the surfaces of work piece 80 for conducting the forming process by utilizing primary forming tool assembly 10 and backing roller tool assembly 20 yet permit securing the work piece within the sheet fixture assembly.

Retainer 52 may comprise a plurality of clamps (not shown) that are positioned around the perimeter of work piece 80. The clamps engage and/or exert sufficient force on work piece 80 and rigid frame 51 to prevent slippage of the work piece and retain its fixed positioning within sheet fixture assembly 50. The clamps preferably are provided along multiple edges or on all edges of rigid frame 51 to surround the opening and fixedly secure work piece 80 therein. Clamps or another mechanism for securely retaining work piece 80 within sheet fixture assembly 50 may be selected and positioned to exert constant, fixed or adjustable force on work piece 80 by manually, hydraulically, electrically or magnetically actuation in accordance with the art.

In Embodiment 3, sheet fixture assembly 50 may be advanced by known means to move work piece 80 back and forth along the Y-axis to its desired location in the X-Y plane. Sheet fixture assembly 50 operates in an analogous manner to that of sheet feeding roller assembly 40 of Embodiment 1. Primary forming tool assembly 10 and backing roller tool assembly 20 operate as described with regard to Embodiments 1 and 2. For example, primary forming tool assembly 10 is positioned adjacent one surface of work piece 80, which is secured in its desired position within sheet fixture assembly 50. Backing roller tool assembly 20 is positioned on the opposite surface and maintained in contact with work piece 80.

By way of illustration, sheet fixture assembly 50 can be moved by one or more motor(s) (not shown) to advance the sheet fixture assembly and secured work piece 80 back and forth along the Y-axis. As a result, sheet fixture assembly 50 precisely moves work piece 80 back and forth to a desired location, preferably along one translational axis (Y-axis).

The operation of Embodiment 3, including primary forming tool assembly 10 and backing roller tool assembly 20, are as described with respect to Embodiment 1, except that the operation of sheet feeding roller assembly 40 of Embodiment 1 is replaced with that of sheet fixture assembly 50, as described.

Sheet fixture assembly 50, primary forming tool assembly 10 and backing roller tool assembly 20 may be controlled by different systems (e.g., mechanical, hydraulic) that may interface directly or indirectly with each other and computing entities to send and receive information regarding their precise positioning at their desired locations to produce the predetermined formation and resulting desired shape for work piece 80. See also motor actuation description with respect to FIGS. 6A-D and FIG. 9 and control system with regard to FIG. 10.

Figure 4A:
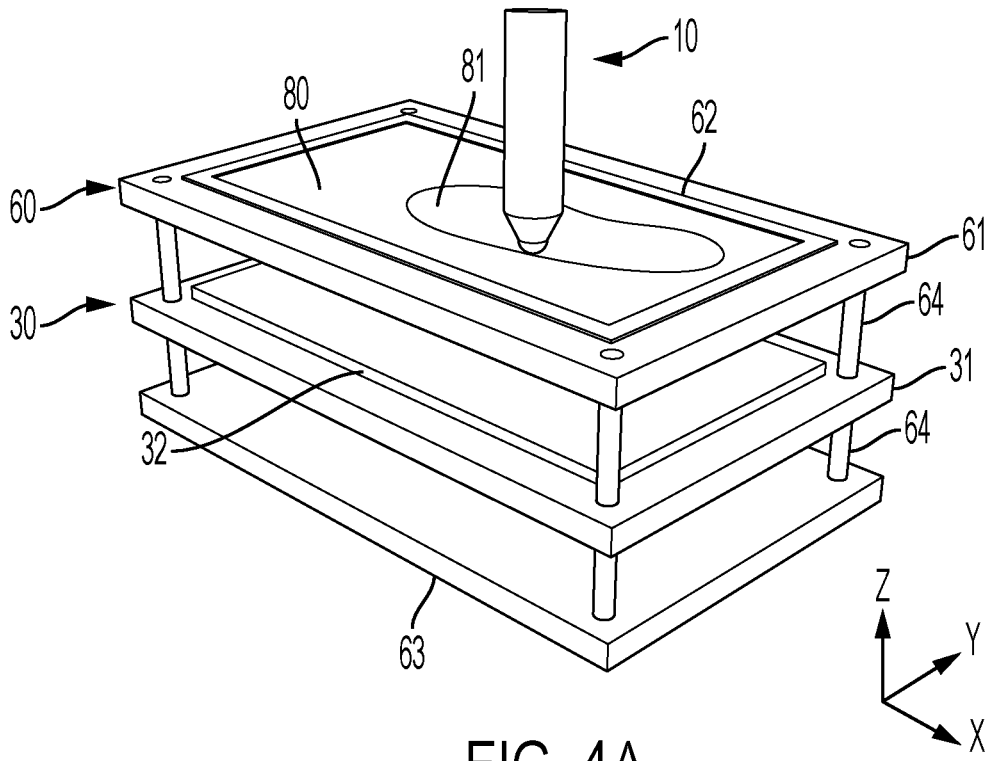
FIGS. 4A and B depict a fourth embodiment (Embodiment 4) of the present ISF system with a fixed frame assembly for holding a work piece, a primary forming tool assembly and a secondary forming tool assembly. In particular.

FIGS. 4A and B depict a fourth embodiment (Embodiment 4) of an inventive ISF sheet forming machine. This embodiment is a three-tier assembly comprising sheet fixture assembly 60, secondary forming tool assembly including backing flat tool assembly 30, and lower platform 63, that are connected and supported by a plurality of posts 64. Embodiment 4 also includes primary forming tool assembly 10 and work piece 80, which previously have been described previously with regard to Embodiments 1, 2 and 3.

Sheet fixture assembly 60 comprises rigid frame 61 and retainer 62 for restraining the movement of and capable of fixedly securing work piece 80 in a desired position. Sheet fixture assembly 60 and its components, rigid frame 61 and retainer 62, are similar in material, design and configuration to that of sheet fixture assembly 50 of Embodiment 3 with the exception that unlike sheet fixture assembly 50, sheet fixture assembly 60 is not directly actuated.

Backing flat tool assembly 30 in Embodiment 4 comprises flat rigid plate 31 and a flat layer of flexible, resilient surface material layer 32 secured to the surface of plate 31 that is adjacent work piece 80. Material outer layer 32 also may be a flat outer surface portion of backing flat tool assembly 30. Plate 31 may be made of steel, aluminum or some other suitably rigid material know in the art.

Similar to resilient layer 22 of Embodiment 1, 2 and 3, resilient layer 32 of Embodiment 4 is made of a resilient, deformable and compressible material having a durometer that is selected so that the layer is capable of being deformed under the force applied on work piece 80 applied by primary forming tool assembly 10 when the work piece is formed. The material selected for resilient layer 32 also is capable of substantially returning to its original configuration as the force from work piece 80 (originating from the primary forming tool assembly 10) is removed and the backing roller assembly moves away from the second surface of the work piece along the Z-axis while the work piece moves to a newly selected location.

For example, resilient layer 32 may be made of an elastomer, preferably polyurethane as described with regard to Embodiment 1. Alternatively, resilient layer 32 may also be made of rubber, neoprene or another suitable material of a durometer that is capable of flexibility, compression and deformability when in contact with work piece 80 yet resiliency and elasticity when no longer in contact with the work piece. In other words, the durometer for resilient layer 32 will depend on the values of the hardness, compressibility and resilience of the material selected which may vary depending on the material of the work piece 80 and the final desired shape.

In Embodiment 4, resilient layer 32 generally has a hardness durometer ranging from about a Shore 10A to about 80D, preferably about 30A to about 95A. Depending on hardness of the material selected, the thickness of resilient layer 32 varies between about 0.01 mm and about 25 mm, preferably about 1.0 mm to about 5.0 mm.

Resilient layer 32 preferably comprises a preformed sheet of resilient material (as described above) that is secured by being affixed to rigid plate 31 with an adhesive, a retainer such as clamps or another suitable attachment method know in the art. Alternatively, resilient layer 32 may be secured by frictional means known in the art.

Another method for constructing backing flat tool assembly 30 is to apply a flat layer of an adhering liquid version of the aforementioned resilient materials to the upper surface of plate 32 and let the material cure in place so as to be secured to the plate. The resilient materials may be rendered suitably flat by leveling, machining, grinding or another fabrication means.

In Embodiment 4 (See e.g., FIGS. 4A and B), four support posts 64 extend between sheet fixture assembly 60 and backing flat tool assembly 30 and continue to extend between backing flat tool assembly 30 and lower platform 63. Support posts 64 may be provided as solid or hollow tubular members. Posts 64 are preferably configured and dimensioned so that backing flat tool assembly 30 is capable of sliding freely along the posts in the Z direction so as to remain in continuous contact with the surface of work piece 80 during the forming process while primary forming tool assembly 10 exerts force on the work piece.

In FIG. 4A, support posts 64 are shown as being positioned within defined openings of backing flat tool assembly 30. However, posts 64 may be modified or replaced by another suitable means known in the art that would permit vertical movement (i.e., along the Z-axis) of backing flat tool assembly 30 relative to the work piece 80 (e.g., including rail systems). This sliding movement permits backing flat tool assembly 30 to be capable of remaining in continuous contact with work piece 80 while primary forming tool assembly 10 exerts force on the work piece.

Analogous to the operation of backing roller tool assembly 20 of Embodiments 1-3, backing flat tool assembly 30, is movable along a single axis (Z-axis as shown in FIGS. 4A and B) and stays nominally flat in relation to sheet fixture assembly 60, parallel to the X-Y plane defined by work piece 80.

By way of illustration, sheet fixture assembly 60 can be moved by one or more motor(s) (not shown) along the Z-axis. Sheet fixture assembly 60, primary forming tool assembly 10 and backing flat tool assembly 30 may be controlled by different systems (e.g., mechanical, hydraulic) that may interface directly or indirectly with each other and computing entities to send and receive information regarding their precise and independent positioning at their desired locations. See also motor actuation description with respect to FIGS. 6A-D and the description with regard to FIG. 9 and control system with regard to FIG. 10.

In FIGS. 4A and B, forming tool 10 is can move in X, Y and Z directions relative to sheet fixture assembly 60 and work piece 80 by different systems (e.g. mechanical or hydraulic) not shown. Rigid frame 61 and retainer 62 of sheet fixture assembly 60 may be secured to lower platform 63 via a series of support posts 64. Backing flat tool assembly 30, which comprises plate 31 and resilient layer 32, is positioned between sheet fixture assembly 60 and lower platform 63.

Figure 5:
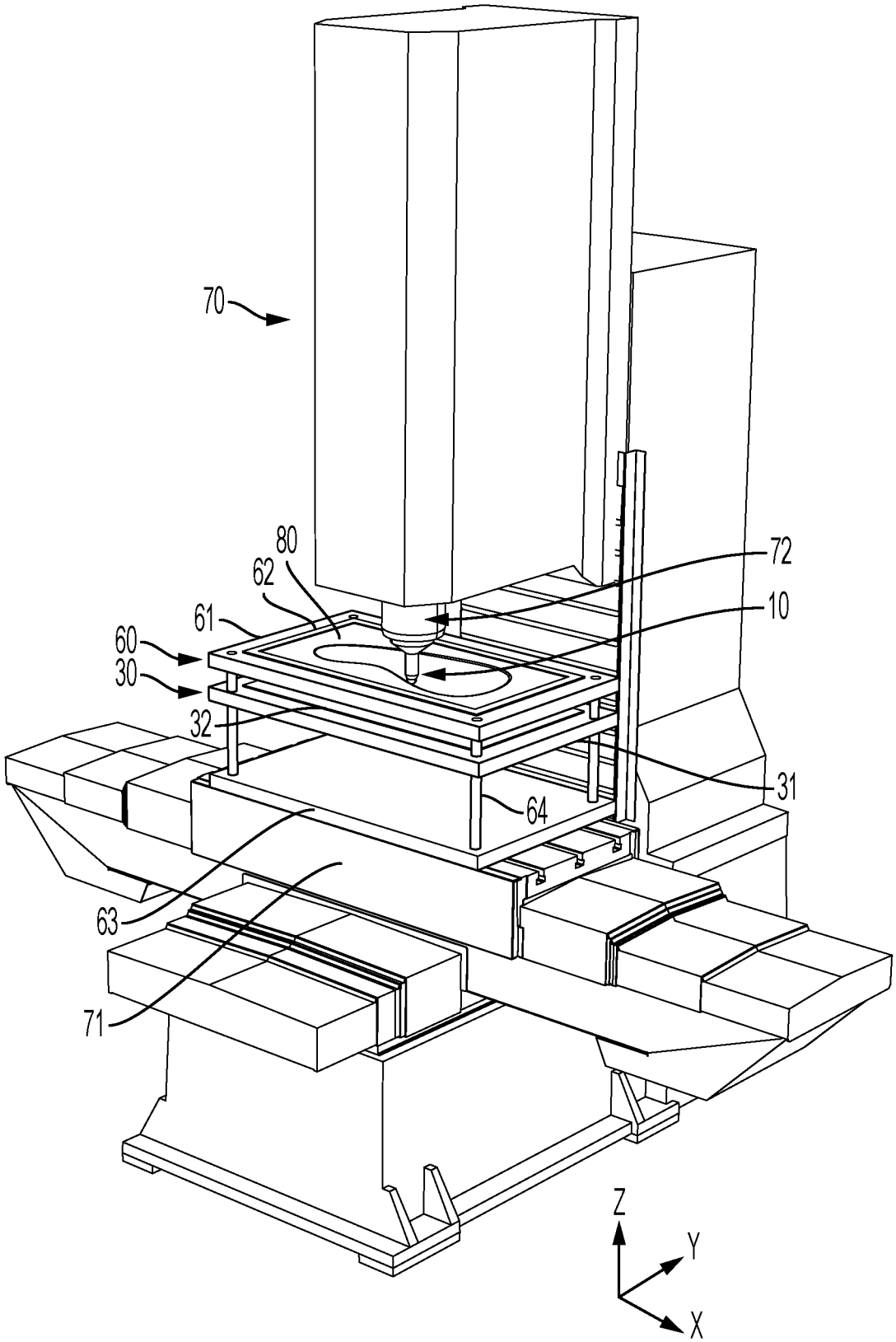
FIG. 5 depicts another exemplary axonometric view of Embodiment 4 as incorporated into a machine center.

FIG. 5 illustrates an alternative way for the operation of Embodiment 4. In FIG. 5, Embodiment 4 has been incorporated into a Vertical Machining Center 70 (hereinafter VMC). In this example, primary forming tool assembly 10 is inserted into spindle assembly 72 of VMC 70. Lower platform 63 is affixed to worktable assembly 71 of VMC 70.

As discussed with regard to FIGS. 4A and B, in FIG. 5, rigid frame 61 and retainer 62 of sheet fixture assembly 60 may be secured to lower platform 63 via a series of support posts 64. Backing flat tool assembly 30, which comprises rigid plate 31 and resilient layer 32, is positioned between sheet fixture assembly 60 and lower platform 63. The resulting three-tiered apparatus can be controllably moved in three directions (along X, Y and Z axes) relative to primary forming tool assembly 10 via VMC 70.

By moving worktable assembly 71 in conjunction with spindle assembly 72, VMC 70 provides translational movement along three axes (X, Y and Z axes) of work piece 80 relative to the primary forming tool 10. Movement of backing flat tool assembly 30 vertically along the Z-axis can be synchronized, for example, via a motion controller of VMC 70, a secondary control, or combinations of the two (not shown) as are known in the art. Moreover, backing flat tool assembly 30 additionally may be moved further along the Z-axis toward or away from work piece 80 by one or more motors in coordination with VMC 70. See also motor actuation description with respect to FIGS. 6A-D, the description with regard to FIG. 9 and that of the control system with regard to FIG. 10.

Alternative embodiments using other types of machining centers known in the art such as for example Horizontal Machining Centers and machining centers operational on 5 axes are possible and contemplated herein. Additional embodiments also may include incorporating primary forming tool assembly 10 and backing flat tool assembly 30 into other existing machinery in accordance with the art without departing from the principles disclosed herein.

FIGS. 6A-D, 7 and 8A and B respectively show exemplary cross-sectional views of work piece 80 undergoing a sequence of incremental forming steps along illustrative work paths in accordance with embodiments of the present invention.

FIGS. 6A-D depict exemplary front cross-sectional views of a work piece undergoing a sequence of incremental forming steps from starting as a flat sheet (See e.g., FIG. 6A) through its forming into a final configuration 81 (See e.g., FIG. 6D) in accordance with embodiments of the present invention.

Figure 4B:
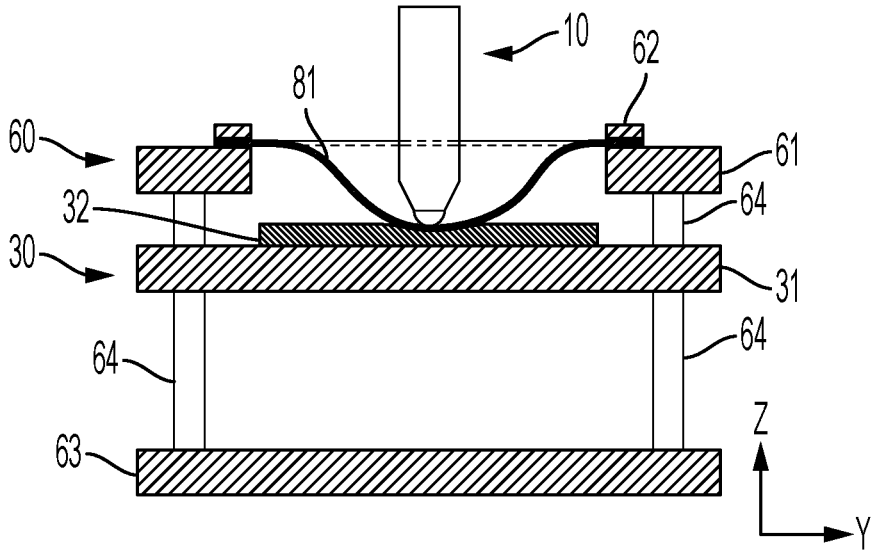
FIG. 4B depicts an exemplary front cross-section view of Embodiment 4.

More specifically, FIGS. 6A-D show primary forming tool assembly 10, work piece 80 and backing forming tool assembly 90. Backing forming tool assembly 90 comprises resilient surface material layer 92 (or the outer surface portion of backing tool assembly 90), secured to rigid backing 91. Backing forming tool assembly 90 represents any of those secondary forming tool assemblies of any of the previous embodiments that include either resilient backing roller tool assembly 20 (See e.g., FIGS. 1A-C, 2A-C and 3A-C) with resilient layer 22 and core 21 or include backing flat tool assembly 30 (See e.g., FIGS. 4A-B and 5) with resilient layer 32 and rigid plate 31.

During the forming process, work piece 80 is pressed between primary forming tool assembly 10 and backing forming tool assembly 90. Primary forming tool assembly 10 exerts controlled force onto one surface of work piece 80. As a result, work piece 80 deforms and places force on resilient layer 92. In turn, resilient layer 92 compresses and places a counter force from the opposite surface of work piece 80 so as to support the work piece at the localized area or contact surrounding primary forming tool assembly 10. As a result, work piece 80 is plastically and permanently formed.

Resilient layer 92 remains compressed while in contact with work piece 80. Resilient layer 92, however, returns to its pre-compressed configuration once backing forming tool assembly 90 moves along the Z-axis away from work piece 80 to another preprogrammed and predetermined position.

During the forming process, primary forming tool assembly 10 stays firm due to its hardness and rigidity. Due to its plasticity and pliability, work piece 80 is readily and permanently formed by the force applied on it by primary forming tool assembly 10. In turn, resilient layer 92 also temporarily deforms on account of the force exerted on it by work piece 80.

In operation, resilient layer 92 may be compressed with respect to the Z-axis, in a range of about 0.001 to about 0.2 inches or larger, preferably about 0.005 to about 0.1 inches, depending upon the material selected, its thickness and the dimensions of work piece 80

In FIGS. 6A-D, primary forming tool assembly 10 and backing forming tool assembly 90 preferably are controlled by an electro-mechanical positioning system having a predetermined or preprogrammed motion that results in localized controlled force on work piece 80. In other words, CNC programming techniques are utilized that relate to establishing controlled positioning of the various tools in order to achieve this result and desired formation of work piece 80. The means for controlling the progression of formation of work piece 80 as depicted in FIGS. 6A-D is further described below with regard to FIGS. 7, 8A, 8B and 10.

All embodiments are preferably actuated by such electro-mechanical means. Servo motors are the preferable electro-mechanical drive means. Stepper motors are also usable as an electro-mechanical drive means. Additionally, precision hydraulics may be utilized for one or more of the actuated axes of the mechanical system as an alternate. See also FIG. 10 and its accompanying description.

Alternatively, the primary forming tool assembly 10 or backing forming tool assembly 90 or both tools may be controlled as a function of pressure. In this alternative method, either or both primary forming tool assembly 10 and backing forming tool assembly 90 is controlled in the Z direction by an electro-mechanical positioning system that exerts a targeted force on work piece 80. This would allow the pressure-controlled tool (or tools) to vary their position in the Z-axis in order to keep a predetermined pressure on their corresponding surfaces of work piece 80. In other words, other known CNC programming techniques are utilized that relate to specified pressure values. See U.S. Pat. No. 7,536,892, the entire content of which is incorporated herein by reference.

Figure 6A:
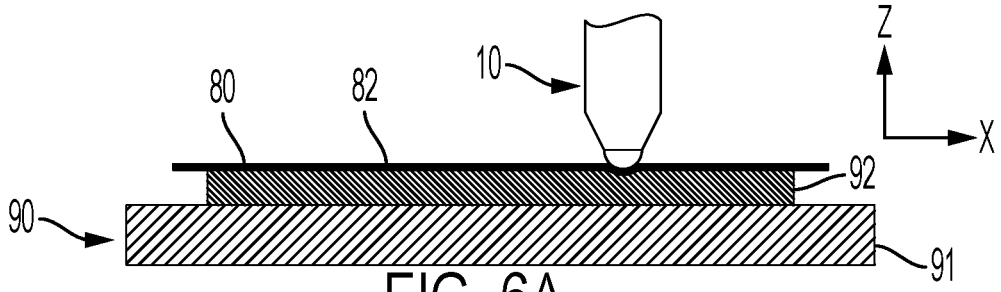
FIGS. 6A-D depict exemplary front cross-sectional views of a work piece undergoing a sequence of incremental forming steps in accordance with embodiments of the present invention.
Figure 6B:
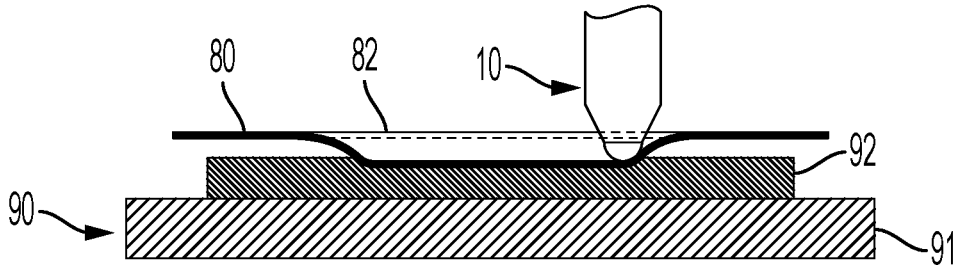
Figure 6C:
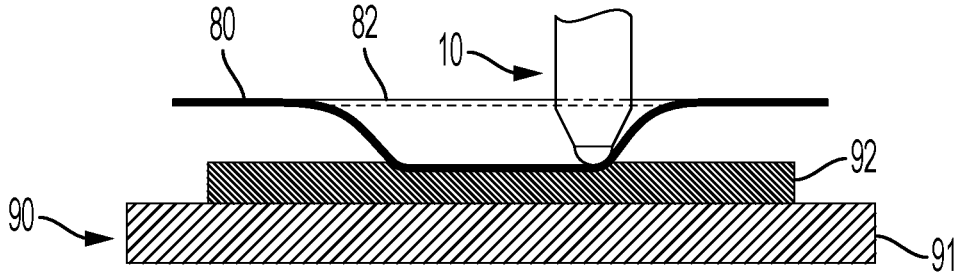
Figure 6D:
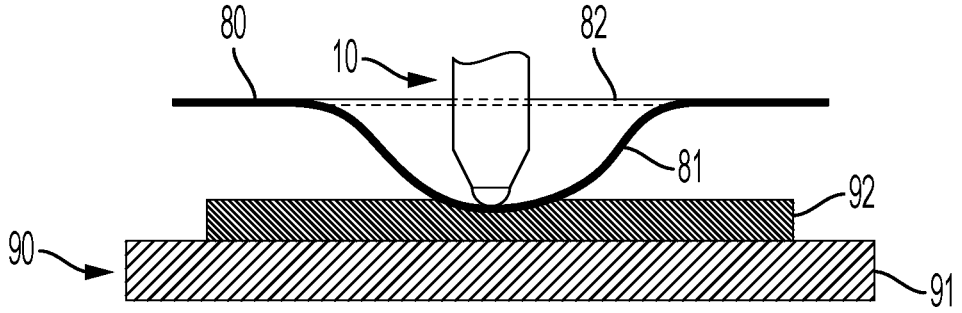
Figure 7:
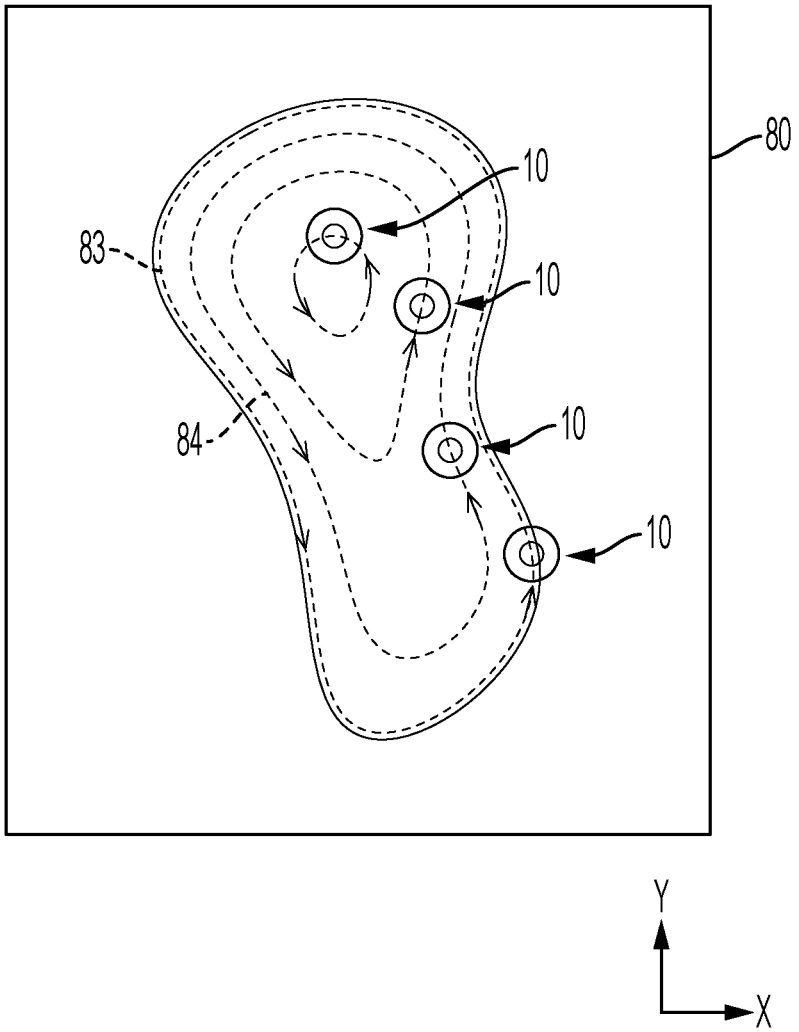
FIG. 7 is an exemplary top view of a work piece that is being formed in accordance with embodiments of the present invention.

As seen in FIG. 7, primary forming tool assembly 10 illustratively moves along outer tool path 83 on a plane offset from the plane defined by original work piece 80. Primary forming tool assembly 10 advances along the Z-axis, applying controlled force to work piece 80 as shown in FIGS. 6A-D. As primary forming tool assembly 10 then moves along outer tool path 83, the primary forming tool continues to apply force to work piece 80, While work piece 80 is being formed, resilient layer 92 of secondary forming tool assembly (e.g., backing forming tool assembly 90) also deforms and applies a controlled counter force on the work piece from the opposite surface. As a result, work piece 80 receives a localized force in the area in which it is contacted by forming tool assembly 10 and is plastically formed along a selected tool path.

By way of further illustration, FIG. 7 depicts work piece 80 which has one work area with multiple tool paths where formation of the work piece increases toward the center of the work piece. As a result, once the first tool path 83 run is completed, backing forming tool assembly 90 moves away (along the Z-axis) by a predetermined distance from the lower surface of work piece 80, and primary forming tool assembly 10 moves towards work piece 80 along second tool path 84 along the Z-axis to provide sufficient reactive force to the work piece to counter the forming force on the work piece from the primary forming tool assembly 10. Backing forming tool assembly 90 continuously moves in tandem with the movements of the primary forming tool assembly 10 to remain substantially opposite the tip of the primary forming tool assembly with the work piece therein between. As a result, localized formation forces are maintained on the work piece.

Primary forming tool assembly 10 forms the surface of work piece 80 by forcing the work piece into resilient layer 92 (See FIGS. 6A and 7). When finished, the forming process begins again on next tool path 84 (See FIG. 7). The process is repeated (See FIGS. 6B and 7) based on each successive tool path until the forming process is completed and work piece 80 is formed in its final configuration 81 (See FIGS. 6C, 6D and 7).

Figure 8A:
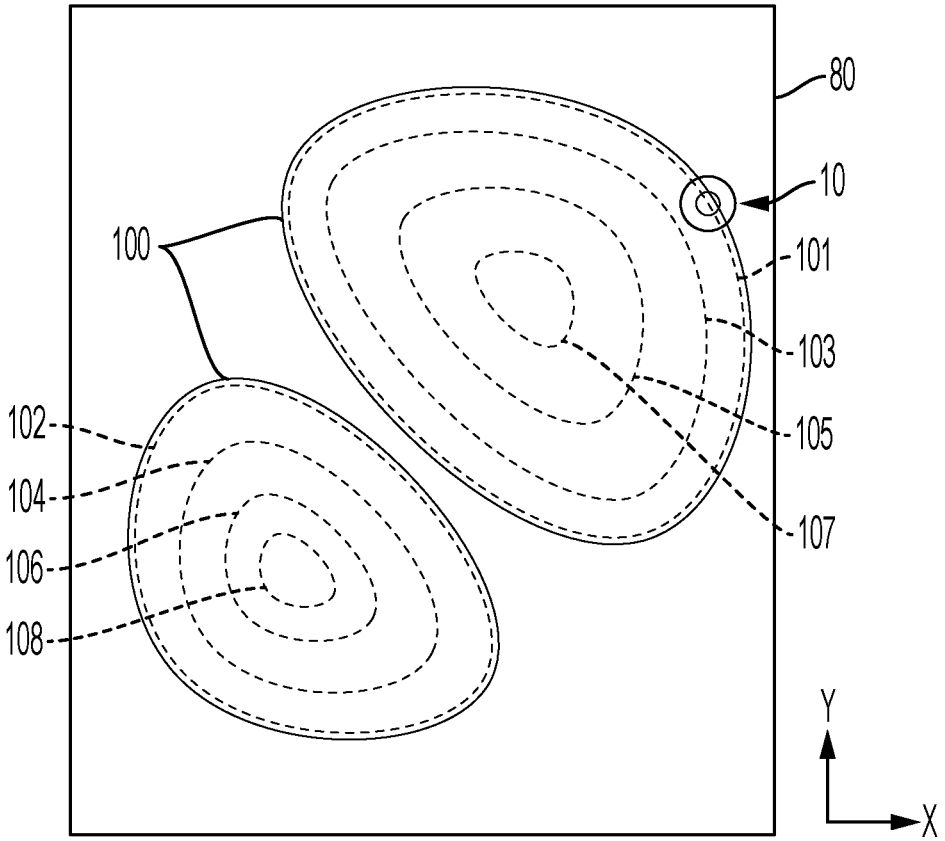
FIGS. 8A and B depict a method for forming multiple formation areas in a single work piece undergoing a sequence of incremental forming steps in accordance with embodiments of the present invention. In particular.

As illustrated in FIGS. 8A and B, other tool path methods may be used to create configurations with more than one formed or work area 100 per sheet of material. Specifically, FIGS. 8A and B show work piece 80 with two work areas 100 that are separated from each other. These figures depict a method for forming multiple formations in the two separate work areas on work piece 80 that is undergoing a sequence of incremental forming steps in accordance with the embodiments of the present invention. The method is applicable to work pieces have one or multiple work areas.

FIG. 8A depicts tool paths 101 through 108. Tool paths 101, 103, 105 and 107 are applicable to a first formed areas 100, and tool paths 102, 104, 106 and 108 are applicable to a second formed areas 100.

Figure 8B:
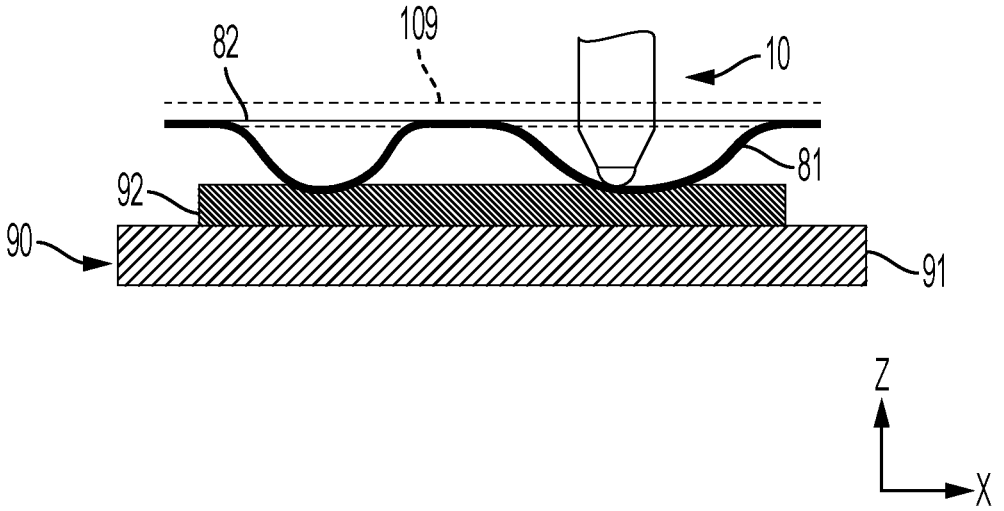
FIG. 8B depicts an exemplary front cross-sectional view of a work piece undergoing a sequence of incremental multiple forming steps in accordance with embodiments of the present invention, and in particular as depicted in FIG. 8A.

FIG. 8B depicts an exemplary final front cross-sectional view of a work piece having undergone a sequence of incremental multiple forming steps in accordance with the embodiments of the present invention into its newly formed final configuration 81. More specifically, FIG. 8B shows primary forming tool assembly 10 and secondary forming tool assembly (e.g., backing forming tool assembly 90). The secondary forming tool assembly comprises resilient layer 92 (comparable to resilient layer 22 of Embodiments 1-3 and resilient layer 32 of Embodiment 4) and rigid backing 91 (comparable to core 21 of Embodiments 1-3 and rigid plate 31 of Embodiment 4).

In this example, primary forming tool assembly 10 follows tool paths 101-108 in numerical sequence (i.e., in the order of 101, 102, 103, 104, 105, 106, 107, and finally 108.) In this example, tool paths 101 and 102, 103 and 104, 105 and 106, 107 and 108 respectively are positioned along an X-Y plane at substantially the same position on the Z-axis.

In accordance with this illustrative incrementally forming method, primary forming tool assembly 10 moving to the selected Z-axis position of tool path 101 somewhere along the length of tool path 101. Resilient backing forming tool assembly 90 moves in the Z-axis direction to substantially the same Z-axis position as that of tool path 101 (or a preselected dimensional offset in the positive or negative position in the Z-axis direction) which is substantially the same as that of tool path 101. Primary forming tool assembly 10 then proceeds to exert force along tool path 101 as work piece 80 forms and resilient backing forming tool assembly 90 supports the work piece. When movement along tool path 101 is completed, primary forming tool assembly 10 then retracts in the Z-axis direction, away from work piece 80, past the original X-Y reference plane 82 of work piece 80 to X-Y clearance plane 109 (see FIG. 8B).

Clearance plane 109 is located at a sufficient distance away from reference plane 82 to allow primary forming tool assembly 10 not to be in contact with the surface of work piece 80. Then, primary forming tool assembly 10 proceeds to a newly selected X-Y location above tool path 102 while still positioned along clearance plane 109. Primary forming tool assembly 10 then moves toward work piece 80 to substantially the same Z-axis position on tool path 102 as previously selected for tool path 101.

Primary forming tool assembly 10 proceeds to exert force along tool path 102 as work piece 80 forms and resilient backing forming tool assembly 90 supports the work piece. As a result, the amount of formation of work piece 80 along tool path 102 is substantially the same amount of formation along tool path 101. During the movement of primary tool assembly 10 along tool paths 101 and tool path 102, in this example, backing forming tool assembly 90 has not changed its position on the Z-axis.

Primary forming tool assembly 10 retracts again in the Z-axis direction, away from work piece 80, past the original reference plane 82 and back to clearance plane 109. Primary forming tool assembly 10 then proceeds to an X-Y location above tool path 103. Resilient backing forming tool assembly 90 also moves away from work piece 80 to a preselected Z-axis position (or a dimensional offset in the positive or negative dimension in the Z-axis direction). Primary forming tool assembly 10 then moves to the selected Z-axis level of tool path 103 and proceeds along tool path 103. When the formation is completed along tool path 103, primary forming tool assembly 10 proceeds to a newly selected X-Y location above tool path 104 while still positioned along clearance plane 109. Primary forming tool assembly 10 then moves toward work piece 80 to substantially the same Z-axis position on tool path 104 as previously selected for tool path 101.

Primary forming tool assembly 10 proceeds to exert force along tool path 104 as work piece 80 forms and resilient backing forming tool assembly 90 supports the work piece. As a result, the amount of formation of work piece 80 along tool path 104 is substantially the same amount of formation as along tool path 103. During the movement of primary tool assembly 10 along tool paths 103 and tool path 104, in this example, resilient backing forming tool assembly 90 has not substantially changed its position on the Z-axis.

This method then repeats and continues for tool paths 105 and 106, 107 and 108, until work piece 80 is formed into its final shape with multiple formations. In other words, those tool paths which are to be formed at substantially the same Z-axis level are processed all in sequence so as to form all tool paths having substantially the same Z-axis level of the final configuration.

In accordance with the inventive method, multiple formations on a single sheet of material do not need to have the same final shape or the same final amount of formation. Where different configurations of multiple formations are required on a single sheet of material, the above incremental process would start along the tool paths where the least amount of formation is contemplated for the multiple formations. Then, the process moves onto the tool paths where the next amount of formation is contemplated, and then continues until all tool path configurations are completed and the final form is achieved.

Figure 9A:
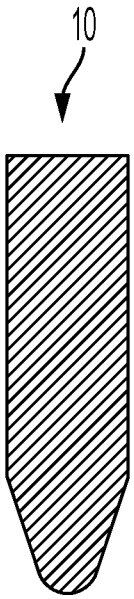
FIGS. 9A-C depict cross-sectional views of various primary forming tools contemplated for use in practicing the present invention. In particular.
Figure 9B:
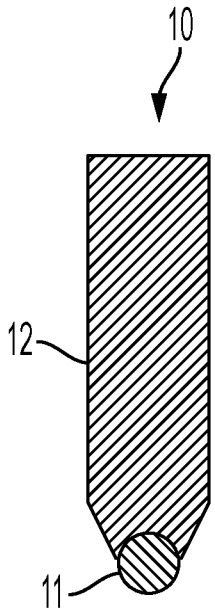
Figure 9C:
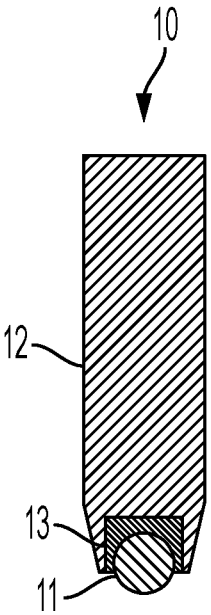

FIGS. 9A-C depict cross-sectional views of various primary forming tool assemblies in accordance with the present invention.

FIG. 9A depicts primary forming tool assembly 10 as comprising a solid tool made of any suitable rigid material, usually hardened steel or engineered ceramic. The tip of primary forming tool assembly that would contact work piece 80 can be of any shape. Depending on the application, the tip preferably is spherically shaped. Primary forming tool assembly 10 may also have a surface treatment such as further hardening or coatings as is known in the art for metal working tools.

FIG. 9B depicts primary forming tool assembly 10 as comprising tool shaft 12 and attached tool tip 11. Tool shaft 12 can be made of any suitable material, usually hardened steel. Tool shaft 12 may also have additional surface treatment such as hardening or coatings as is known in the art of metal working tools.

Tool tip 11 preferably is spherical shaped although other shapes are possible and contemplated. Tool tip 11 may be made of any suitably hard and rigid material, preferably ceramic or steel alloy. Tool tip 11 may be fixedly fastened to tool shaft 12, either mechanically or through adhesion. Tool tip 11 may alternatively be designed to be retained by and freely rotate against tool shaft 12 as mentioned below.

FIG. 9C depicts primary forming tool assembly 10 as comprising tool shaft 12, tool tip 11 and plain bearing 13 positioned between tool tip 11 and tool shaft 12. This embodiment acts analogously to that of a ball point pen with its rolling tip.

All or part (e.g., tip 11) of primary forming tool assembly 10 preferably comprises engineered grade ceramic material. In other words, one or more components 11, 12, and 13 in each of FIGS. 9A-C preferably may be made of engineered ceramic having a hardness greater than the hardness of work piece 80. Depending on the actual material of work piece 80, a number of technical or engineering grade ceramics may be used, including oxide ceramics and non-oxide ceramics such as but not limited to silicon nitride, aluminum nitride, zirconium oxide, silicon carbide and aluminum oxide. Silicon nitride ($Si_3N_4$) ceramic often is preferred. The hardness of primary forming tool assembly 10 and its tool tip 11 is greater than that of work piece 80.

Depending on the size of the work piece being formed and the final formation detailing required, tool tip 11 preferably is spherical in shape and its diameter preferably ranges from about 0.125 inches to about 2.0 inches, more preferably about 0.50 inches to about 1.50 inches for larger work pieces, and preferably about 0.125 inches to about 0.50 inches for smaller work pieces.

It also has been found that incorporating an engineering grade ceramic as part of primary forming tool assembly 10 minimizes the need for constant lubrication of the work piece as otherwise would be required by the prior art devices. Advantageously, spherical balls of engineered ceramic (e.g., particularly silicon nitride) when used as tool tip 11 in accordance with the inventive method do not shatter despite the force and resulting friction applied on work piece 80. These engineered ceramic tips also create a polished or burnished finish to the formed sheet of material such as sheet metal.

Suitable materials for plain bearing 13 include but are not limited to ceramic, metal or plastic in accordance with known bearing materials.

Figure 10:
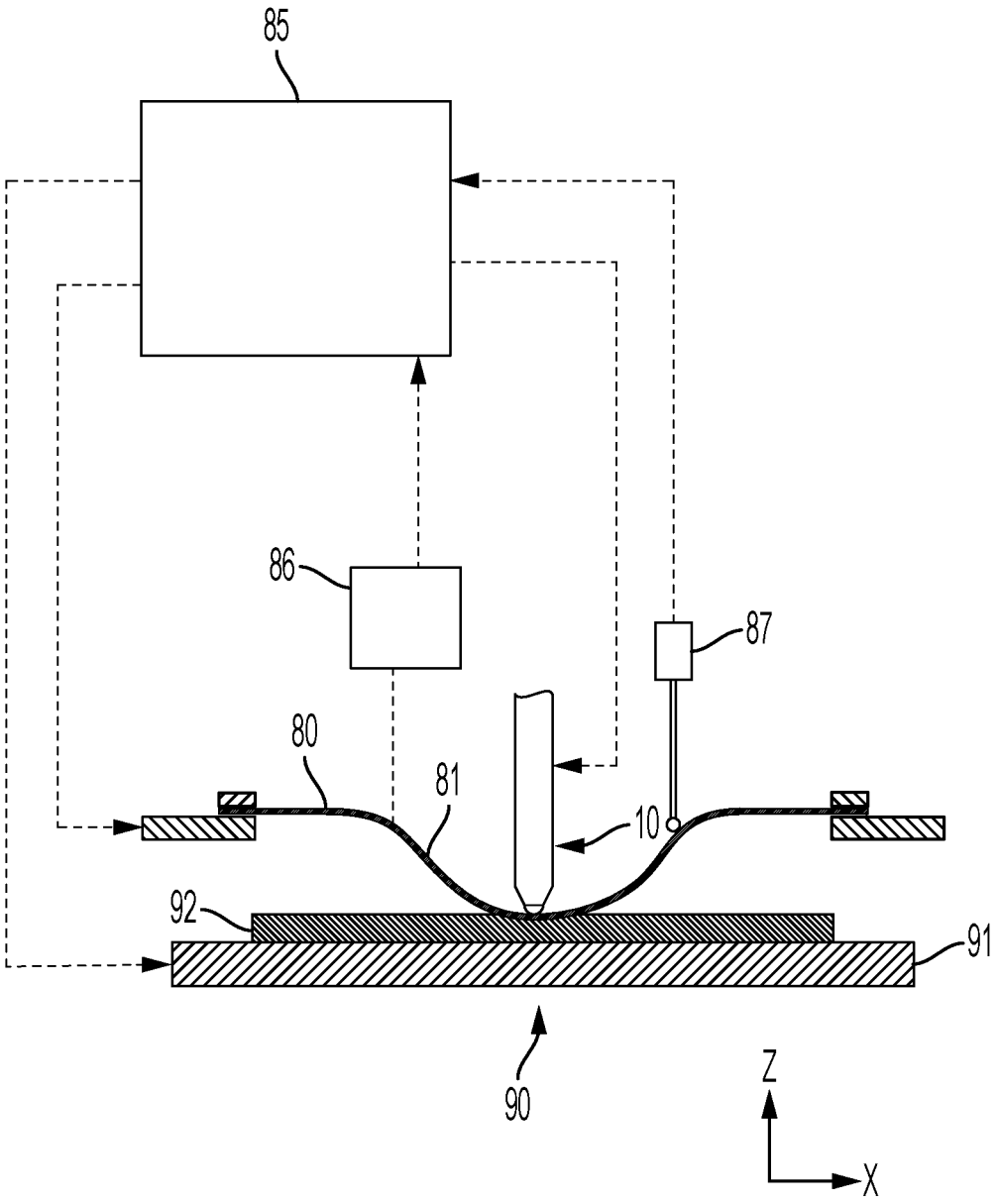
FIG. 10 depicts a partial cross-sectional view of the above embodiments of the present invention with a diagram of a synchronized control system.

FIG. 10 depicts a partial cross-sectional view of embodiments of the present invention in combination with a synchronized control system. FIG. 10 shows synchronized controller assembly 85, non-contact measurement sensor 86 and contact measuring sensor 87. FIG. 10 also shows primary forming tool assembly 10, and secondary forming tool assembly (e.g., backing forming tool assembly 90). The secondary forming tool assembly comprises resilient layer 92 (comparable to resilient layer 22 of Embodiments 1-3 and resilient layer 32 of Embodiment 4) and rigid backing 91 (comparable to core 21 of Embodiments 1-3 (See e.g., FIGS. 1A-B, 2A-B and 3A-B) and rigid plate 31 of Embodiment 4 (See e.g., FIGS. 4A-B and 5)).

In FIG. 10, one or more controllers or control modules may be provided for a synchronized controlling operation applicable with the components described in the above embodiments. By way of illustration, synchronized controller assembly 85 monitors and controls the precise positioning of sheet feeding roller assembly 40 (See e.g., FIGS. 1A-C) or sheet feeding belt assembly 43 (See e.g., FIGS. 2A-C) or sheet fixture assembly 50 (See e.g., FIGS. 3A-C) or worktable assembly 71 (See e.g., FIG. 5) of the prior embodiments (not all components are shown in FIG. 10), primary forming tool assembly 10, and secondary forming tool assembly 90 (similar to backing roller tool assembly 20 (See e.g., FIGS. 1A-B, 2A-B and 3A-B) or backing flat tool assembly 30 (See e.g., FIGS. 4A-B and 5)). Synchronized controller assembly 85 may interact with the various subsystems directly. Alternatively, synchronized controller assembly 85 may interact indirectly by obtaining position information for each subsystem to determine and provide a coordinated control.

In FIG. 10, synchronized controller assembly 85 may operate based on NC (numeric control) data in accordance with the art. Synchronized controller assembly 85 may be adapted to receive CAD data from which to derive numerical control data to form work piece 80 to design specifications. Controller assembly 85 may monitor the position and formation process of work piece 80 via contact sensor 87 that physically contacts work piece 80, or without physical contact via non-contact sensor 86 (i.e. laser or optical measurement system). The control system including synchronized controller assembly 85, contact sensor 87, and non-contact sensor 86 may monitor the position of work piece 80 at the start of the inventive forming process and preferably repeatedly throughout the forming process.

In accordance with FIG. 10, a non-contact sensor 86 or contact sensor 87 is provided as described above to measure the amount of formation of the work piece 80 at specified positions along the path of formation of the work piece. The resulting measurements from sensors 86 or 87 are compared to a predetermined amount of formation at the same specified positions along the path of formation. The resulting compared measurements are relayed to the controller assembly 85. Controller assembly 85 then adjusts the position of at least one of primary forming tool assembly 10 and backing forming tool assembly 90 relative to the preprogrammed amounts of required formation along the path so as to form the work piece into the predetermined shape. See also U.S. Pat. No. 7,536,892.

While the control system depicted in FIG. 10 is shown in connection with a preferred embodiment, this control system can be utilized with any of the embodiments of the invention which are described herein.

Detailed embodiments of the present invention are disclosed herein. However, it is to be understood that the disclosed embodiments are merely exemplary of the invention that may be embodied in various and alternative forms. The figures are not necessarily to scale. Some features may be exaggerated or minimized to show details of particular components. Therefore, specific structural and functional details disclosed herein are not to be interpreted as limiting, but merely as a representative basis for the claims and/or as a representative basis for teaching one skilled in the art to variously employ the present invention.

Moreover, in the figures, reference is made to the X, Y and Z axes of a 3-dimensional orthogonal coordinate system with regard to the movement of the various components (e.g., sheet feeding roller assembly 40 or sheet feeding belt assembly 43 or sheet fixture assembly 50 or sheet fixture assembly 60; primary forming tool assembly 10; and backing roller tool assembly 20 or backing flat tool assembly 30 or backing forming tool assembly 90), all relative to each other. It is to be understood that the movement of the various components is intentioned to be depicted in relation to the movement of each of the other components and a reference plane, as applicable (i.e., defined by the initial configuration of the work piece prior incrementally forming).

Additionally, reference is made to certain surfaces being first or second surfaces, upper or lower, or vertical or horizontal and the like. Such descriptions of direction are intended to be consider in relation to the appropriate X, Y and Z axes as shown in the applicable figures.

Furthermore, the reference plane is depicted as X-Y plane 82 in FIGS. 1A, 6A-D and 8B. For simplicity, the reference plane is not shown in the other drawings but is intended to be the initial generally flat configuration of work piece 80 along an X-Y plane prior to incremental formation.

The invention claimed is:

1. An apparatus for incrementally forming a work piece made from metal or plastic sheet material having first and second opposed parallel surfaces, a working area, and defining a reference plane that is parallel to both surfaces, which comprises:

a. a primary forming tool assembly positioned adjacent to and facing the first surface of the work piece and arranged to move into and out of engagement with the work piece in a direction perpendicular to the reference plane so as to exert a forming force on the first surface of the work piece without perforating the work piece;

b. a secondary forming tool assembly configured and arranged for rotating about an axis and having a compressible and resilient outer surface portion which faces the second surface of the work piece, the secondary forming tool assembly being arranged to move into and out of engagement with the work piece in a direction perpendicular to the reference plane; and c. a sheet feeding assembly configured and arranged to receive and move the work piece in a direction parallel to the reference plane, wherein at least one of the work piece driven by the sheet feeding assembly or the primary forming tool assembly is arranged to move relative to the other in directions parallel to the reference plane and to position the primary forming tool assembly within the working area so that while the primary forming tool assembly exerts the forming force on the first surface of the work piece, the outer surface portion of the secondary forming tool assembly is positioned opposite the primary forming tool assembly and is arranged to engage the second surface of the work piece such that the outer surface portion of the secondary forming tool assembly provides a counter force to the forming force from the primary forming tool assembly, thereby supporting the second surface of the work piece and localizing the forming force on the work piece at a zone of contact between the work piece, the primary forming tool assembly, and the secondary forming tool.

2. The apparatus of claim 1, wherein the primary forming tool assembly comprises a tool shaft having a tip that is arranged to be positioned to face the first surface of the work piece and be in close proximity thereto, the tip being arranged to selectively:

a. move into and out of contacting relation with the first surface of the work piece; and b. exert the forming force on the first surface of the work piece so as to form the work piece into a predetermined configuration without perforating the work piece.

3. The apparatus of claim 2, wherein the tip of the tool shaft comprises an engineered ceramic material.

4. The apparatus of claim 1, wherein the sheet feeding assembly comprises a sheet feeding roller assembly having at least one set of rollers that contact respective first and second surfaces of the work piece, the set of rollers being configured and arranged to move the work piece in a direction parallel to the reference plane.

5. The apparatus of claim 1, wherein the sheet feeding assembly comprises at least one continuous belt that surrounds and contacts a set of rotatable pulleys, the belt arranged to be positioned in contacting relation with the first or second surfaces of the work piece to move the work piece in a direction parallel to the reference plane.

6. The apparatus of claim 1, wherein the secondary forming tool assembly has a cylindrical configuration and further comprises an inner core that is circumferentially surrounded by the outer surface portion of the secondary forming tool assembly and secured thereto, the outer surface portion configured and arranged to:

a. be compressed by force exerted by the work piece thereon as the work piece is formed by the forming force from the primary forming tool assembly; and b. resiliently return to its non-compressed shape as the secondary forming tool assembly moves away from the second surface of the work piece.

7. The apparatus of claim 1, further comprising a control system arranged for simultaneously coordinating the respective movements of: i) the work piece driven by the sheet feeding assembly, ii) the primary forming tool assembly, and iii) the secondary forming tool assembly in relation to each other, wherein the coordinated movements thereof cause the primary forming tool assembly to follow a predetermined path along the first surface of the work piece while the secondary forming tool assembly is simultaneously controlled in positional relationship with the primary forming tool assembly relative to the second surface of the work piece.

8. The apparatus of claim 1, wherein the sheet feeding assembly includes a sheet fixture assembly having a rigid frame and a retainer configured and arranged to:

a. securely retain the work piece therebetween; and b. define an opening for access to the work piece by the primary forming tool assembly on the first surface of the work piece and by the secondary forming tool assembly on the second surface of the work piece.

9. An apparatus for forming a work piece made from metal or plastic sheet material, the work piece having first and second opposed parallel surfaces and defining a reference plane that is parallel to the first and second surfaces of the work piece, which comprises:

a. a sheet feeding assembly configured and arranged to receive and move the work piece in a direction parallel to the reference plane, the sheet feeding assembly having at least one continuous belt that surrounds and contacts a set of rotatable pulleys, the belt being arranged to be positioned in contacting relation with the first or second surfaces of the work piece to move the work piece in a direction parallel to the reference plane; and b. a primary forming tool assembly arranged to be positioned to face the first surface of the work piece and arranged to move-in a direction perpendicular to the reference plane into and out of engagement with the first surface of the work piece so as to exert a forming force on the first surface of the work piece without perforating the work piece, and in a direction parallel to the reference plane; and c. a backing roller tool assembly configured and arranged to move in a direction perpendicular to the reference plane into and out of engagement with the work piece, the backing roller tool assembly having:

i. a cylindrical configuration for rotating about a longitudinal axis of the backing roller tool assembly; and ii. an inner core and an outer compressible and resilient layer secured thereto that is positioned to face the second surface of the work piece, the longitudinal axis of the backing roller tool assembly being positioned parallel to the reference plane;

wherein at least one of the work piece driven by the sheet feeding assembly or the primary forming tool assembly is arranged to move relative to the other in directions parallel to the reference plane, and the primary forming tool assembly and the outer layer of the backing roller tool assembly are arranged to be in simultaneous contact with respective first and second opposed surfaces of the work piece generally opposite each other while the primary forming tool assembly exerts the forming force on the first surface of the work piece to form the work piece and the outer layer of the backing roller tool assembly provides a counter force on the second surface of the work piece as the work piece is being formed thereby supporting the work piece and resulting in a localized force on the work piece within a zone of contact between the primary forming tool assembly, the backing roller tool assembly and the work piece.

10. The apparatus of claim 9, wherein the forming force between the primary forming tool assembly and the first surface of the work piece and the counter force between the outer layer of the backing roller tool assembly and the second surface of the work piece are substantially concentrated at the zone of contact as the work piece is being formed.

11. The apparatus of claim 10, wherein the outer layer of the backing roller tool assembly is configured and arranged to:

a. be compressed by force exerted thereon by the work piece when the primary forming tool assembly forms the work piece; and b. resiliently return to its non-compressed configuration when the backing roller tool assembly moves away from the second surface of the work piece.

12. The apparatus of claim 11, wherein the primary forming tool assembly comprises a tool shaft having a tip that is arranged to be positioned to face toward the first surface of the work piece and be in close proximity thereto, the primary forming tool assembly tip being arranged to selectively:

a. move into and out of contacting relation with the first surface of the work piece; and b. exert the forming force on the first surface of the work piece so as to form the work piece into a predetermined configuration without perforating the work piece.

13. The apparatus of claim 12, wherein the tip of the tool shaft is made of an engineered ceramic material.

14. An apparatus for forming a work piece made from metal or plastic sheet material into a predetermined configuration, the work piece having first and second opposed parallel surfaces and defining a reference plane as an X-Y plane of an "X", "Y", "Z" three-dimensional orthogonal coordinate system, the X-Y plane being parallel to the surfaces of the work piece, the apparatus comprising:

a. a backing roller tool assembly configured and arranged for rotating about an axis and having a compressible and resilient outer surface portion that faces the second surface of the work piece and being parallel to the X Y plane;

b. a primary forming tool assembly positioned adjacent to and facing the first surface of the work piece, the primary forming tool assembly being configured and arranged to move along the X-axis and to exert a forming force on the first surface of the work piece to form the work piece without perforating the work; and c. a sheet feeding assembly including a sheet fixture assembly having a rigid frame and a retainer configured and arranged for securely retaining the work piece therein, the sheet fixture assembly being configured and arranged to position and move the work piece relative to the primary forming tool assembly in a direction parallel to the X Y plane and to define an opening for access to the work piece by the primary forming tool assembly on the first surface of the work piece and by the-backing roller tool assembly on the second surface of the work piece, wherein the primary forming tool assembly and the backing roller tool assembly are positioned opposite each other and arranged for moving along the Z-axis so as to contact respective first and second surfaces of the work piece, such that the forming force exerted by the primary forming tool assembly on the first surface of the work piece is offset by a counter force provided on the second surface of the work piece by the backing roller tool assembly thereby to support locally the work piece while undergoing formation.

15. The apparatus of claim 14, wherein the contact between the primary forming tool assembly and the work piece and the contact between the backing roller tool assembly and the work piece is substantially concentrated within a localized zone of contact between the primary forming tool assembly, the backing roller tool assembly and the work piece.

16. The apparatus of claim 15, wherein the resilient outer surface portion of the backing roller tool assembly is configured and arranged for:

a. being compressed by force exerted thereon by the work piece while the primary forming tool assembly forms the work piece; and b. resiliently returning to its non-compressed configuration while the backing roller tool assembly moves away from the second surface of the work piece.

17. The apparatus of claim 16, wherein the primary forming tool assembly comprises a tool shaft having a tip that is positioned to face toward and be in close proximity with the first surface of the work piece and opposite the axis of the backing roller tool assembly, the primary forming tool assembly being arranged to selectively:

a. move into and out of contacting relation with the first surface of the work piece; and b. exert the forming force on the first surface of the work piece so as to form the work piece into a predetermined configuration without perforating the work piece.

18. The apparatus of claim 17, wherein the tip of the tool shaft is made of an engineered ceramic material.

19. An apparatus for incrementally forming a work piece having first and second opposed surfaces positioned on an X-Y plane of an "X", "Y", "Z" three-dimensional orthogonal coordinate system, which comprises:

a. a primary forming tool assembly arranged to be positioned adjacent to and facing the first surface of the work piece and arranged to move parallel to the X-Y plane and into and out of engagement with the work piece along the Z-axis so as to exert a forming force on the first surface of the work piece without perforating the work piece;

b. a secondary forming tool assembly configured and arranged for rotating about an axis parallel to the X-Y plane, the secondary forming tool assembly having a compressible and resilient outer surface layer of material that is arranged to be positioned to face the second surface of the work piece and move into and out of engagement with the second surface of the work piece along the Z-axis; and c. a sheet feeding assembly configured and arranged to receive and move the work piece parallel to the X-Y plane, wherein the work piece driven by the sheet feeding assembly, the primary forming tool assembly and the secondary forming tool assembly are configured and arranged for independently moving in a predetermined sequence and pattern relative to each other on opposite sides of the work piece, the primary forming tool assembly and the work piece driven by the sheet feeding assembly being arranged to move relative to each other along the X, Y and Z axes such that the primary forming tool assembly is arranged to exert the forming force on the first surface of the work piece and the secondary forming tool assembly is arranged to provide a counter force against the second surface of the work piece thereby supporting the work piece and resulting in a localized force on the work piece within a zone of contact between the work piece, the primary forming tool assembly and the secondary tool assembly while the work piece is being formed.

20. The apparatus of claim 19, wherein the primary forming tool assembly comprises a tool shaft having a tip that is arranged to be positioned to face toward the first surface of the work piece, be in in close proximity thereto and positioned opposite the secondary forming tool assembly, the primary forming tool assembly arranged to selectively:

a. move into and out of contacting relation with the first surface of the work piece; and b. exert the forming force on the first surface of the work piece so as to form the work piece into a predetermined configuration without perforating the work piece.

21. The apparatus of claim 20, wherein the tip of the tool shaft comprises an engineered ceramic material.

22. The apparatus of claim 19, wherein the sheet feeding assembly comprises a sheet feeding roller assembly having at least one set of rollers that contact respective first and second surfaces of the work piece and configured and arranged to move capable of moving the work piece along the Y-axis on the X-Y plane.

23. The apparatus of claim 19, wherein the sheet feeding assembly comprises at least one continuous belt that surrounds and contacts a set of rotatable pulleys, the belt being configured and arranged to be positioned in contacting relation with the first or second surfaces of the work piece to move the work piece along the Y-axis on the X-Y plane.

24. The apparatus of claim 19, wherein the secondary forming tool assembly has a cylindrical configuration arranged for rotating about its axis, the secondary forming tool assembly having an inner core with the outer surface layer of material secured thereto, the outer surface layer configured and arranged to:

a. be compressed by force exerted by the work piece thereon as the work piece is formed by engagement with the primary forming tool assembly; and b. resiliently return to its non-compressed configuration as the secondary forming tool assembly moves away from the second surface of the work piece.

25. The apparatus of claim 24, wherein the outer surface layer of material is circumferentially secured to the inner core by a bearing assembly which facilitates relative movement of the outer resilient layer of material relative to the inner core.

26. The apparatus of claim 19, further comprising a control system arranged for simultaneously coordinating the respective movements of: i) the work piece driven by the sheet feeding assembly, ii) the primary forming tool assembly and iii) the secondary forming tool assembly in relation to each other, wherein the coordinated movements thereof cause the primary forming tool assembly to follow a predetermined path along the first surface of the work piece while the secondary forming tool assembly is simultaneously controlled in positional relationship with the primary forming tool assembly relative to the second surface of the work piece.

27. The apparatus of claim 19, wherein the sheet feeding assembly includes a sheet fixture assembly having a rigid frame and a retainer configured and arranged to:

a. securely retain the work piece therebetween; and b. define an opening for access to the work piece by the primary forming tool assembly and by the resilient secondary forming tool assembly.

* * * * *